US012228289B2

(12) United States Patent
Zhang et al.

(10) Patent No.: US 12,228,289 B2
(45) Date of Patent: Feb. 18, 2025

(54) LATCHING STRUCTURE FOR COOKING DEVICE AND COOKING DEVICE

(71) Applicants: GUANGDONG MIDEA KITCHEN APPLIANCES MANUFACTURING CO., LTD., Guandong (CN); MIDEA GROUP CO., LTD., Guangdong (CN)

(72) Inventors: Xin Zhang, Guangdong (CN); Yanqi Wu, Guangdong (CN); Shuaishuai Wei, Guangdong (CN); Xinchao Zhu, Guangdong (CN)

(73) Assignees: GUANGDONG MIDEA KITCHEN APPLIANCES MANUFACTURING CO., LTD., Guangdong (CN); MIDEA GROUP CO., LTD., Guangdong (CN)

( * ) Notice: Subject to any disclaimer, the term of this patent is extended or adjusted under 35 U.S.C. 154(b) by 474 days.

(21) Appl. No.: 17/720,692

(22) Filed: Apr. 14, 2022

(65) Prior Publication Data

US 2023/0304671 A1 Sep. 28, 2023

Related U.S. Application Data

(63) Continuation of application No. PCT/CN2022/085197, filed on Apr. 2, 2022.

(30) Foreign Application Priority Data

Mar. 22, 2022 (CN) ..... 202210287675.3
Mar. 22, 2022 (CN) ..... 202210288896.2
Mar. 22, 2022 (CN) ..... 202220643886.1

(51) Int. Cl.
*F24C 15/02* (2006.01)
*F24C 7/02* (2006.01)

(52) U.S. Cl.
CPC ..... *F24C 15/022* (2013.01); *F24C 7/02* (2013.01)

(58) Field of Classification Search
CPC ..... F24C 15/022; F24C 7/02; E05B 65/00; E05B 65/0014; E05B 13/00;
(Continued)

(56) References Cited

FOREIGN PATENT DOCUMENTS

CN 105902148 A 8/2016
CN 106724762 A 5/2017
(Continued)

OTHER PUBLICATIONS

PCT—International Search Report (Year: 2022).*
(Continued)

*Primary Examiner* — Michael G Hoang
*Assistant Examiner* — Alter Herbert Foster, IV
(74) *Attorney, Agent, or Firm* — Scully, Scott, Murphy & Presser, P.C.

(57) ABSTRACT

A latching structure for a cooking device and a cooking device having the same are provided. The cooking device has a casing and a door body. The latching structure has a flipping member, a first restoring member, a restricting member and a second restoring member. The first restoring member provides the flipping member with a first restoring force for allowing the flipping member to rotate towards a non-triggered position. The restricting member is movably disposed on the casing between a first position and a second position. The second restoring member is configured to provide the restricting member with a second restoring force for allowing the restricting member to move towards the first position. The latching structure is configured, such that a restoring speed at which the flipping member rotates
(Continued)

towards the non-triggered position is greater than a restoring speed at which the restricting member moves towards the first position.

16 Claims, 16 Drawing Sheets

(58) Field of Classification Search
CPC ..... E05B 17/203; E05B 17/2034; E05B 17/2038; E05B 17/2053; E05B 13/002; E05B 13/004; H05B 6/6414; H05B 6/6417
USPC ..... 126/404
See application file for complete search history.

(56) References Cited

FOREIGN PATENT DOCUMENTS

| | | | | | |
|---|---|---|---|---|---|
| CN | 106913224 | A | | 7/2017 | |
| CN | 106948676 | A | | 7/2017 | |
| CN | 107100456 | A | | 8/2017 | |
| CN | 206625701 | U | | 11/2017 | |
| CN | 111227632 | A | | 6/2020 | |
| CN | 111270917 | A | * | 6/2020 | ..... E05B 65/00 |
| CN | 112021953 | A | * | 12/2020 | ..... F24C 15/022 |
| CN | 212054180 | U | | 12/2020 | |
| CN | 212305700 | U | | 1/2021 | |
| CN | 212958380 | U | | 4/2021 | |
| CN | 215803931 | U | | 2/2022 | |
| CN | 216008153 | U | | 3/2022 | |
| JP | 2010246641 | A | | 11/2010 | |
| KR | 19990062176 | A | | 7/1999 | |

OTHER PUBLICATIONS

International Search Report dated Dec. 27, 2022 received in International Application No. PCT/CN2022/085197.
First Office Action dated Dec. 1, 2022 received in Chinese Patent Application No. CN 202210287675.3.

* cited by examiner

LATCHING STRUCTURE FOR COOKING DEVICE AND COOKING DEVICE

CROSS-REFERENCE TO RELATED APPLICATIONS

This application is a continuation application of PCT International Application No. PCT/CN2022/085197, which claims priority to and benefits of Chinese Patent Application No. 202210288896.2, entitled "LATCHING STRUCTURE FOR COOKING DEVICE AND COOKING DEVICE" and filed on Mar. 22, 2022, Chinese Patent Application No. 202220643886.1, entitled "LATCHING STRUCTURE FOR COOKING DEVICE AND COOKING DEVICE" and filed on Mar. 22, 2022, and Chinese Patent Application No. 202210287675.3, entitled "LATCHING STRUCTURE FOR COOKING DEVICE AND COOKING DEVICE HAVING THE SAME" and filed on Mar. 22, 2022, the entire contents of which are incorporated herein by reference for all purposes. No new matter has been introduced.

FIELD

The present disclosure relates to the field of household appliances, and more particularly, to a latching structure for a cooking device and a cooking device having the latching structure.

BACKGROUND

Cooking devices such as microwave ovens, electric steam ovens, and electric ovens have become commonly used electrical appliances in contemporary family life. When heating of the food in the cooking device is completed, the food is at a high temperature. At present, most of the cooking devices can be opened by pulling a door handle or pressing a button, and a force for opening the door of the cooking device is within 25N. Under this mechanism, for a family with a child, during the use of the cooking device, the child may accidentally touch the door opening button or handle, the cooking device can be opened by lightly pressing or pulling, and there is a risk of the child being scalded by the heated food. In the cooking device in the related art, door opening operation is realized by hooking a switch assembly with a hook. With this structure, the user can easily open the door by pulling the door body or pressing the button once. A locking structure is installed on the cooking device for protecting the child from being scalded due to accidental touch, but the installation of the locking structure makes a great change to the cooking device, which leads to high cost.

SUMMARY

The present disclosure aims to solve at least one of the technical problems existing in the related art. Therefore, embodiments of the present disclosure provide a latching structure for a cooking device. The latching structure for the cooking device can lock the door body. Before opening the door body of the cooking device, it is necessary to release the restriction of the latching structure and then open a switch lock. In this way, the problem that the child accidentally touches the switch lock apparatus to directly open the door body can be avoided, and the safety of using the cooking device is improved.

The present disclosure further provides a cooking device having the latching structure for the cooking device.

In a first aspect, a latching structure for a cooking device according to an embodiment of the present disclosure is provided. The cooking device includes a casing and a door body. The door body is engaged with the casing in an openable and closable manner. The latching structure includes: a flipping member, a first restoring member, a restricting member, and a second restoring member. The flipping member is rotatably disposed on the casing. The flipping member is configured to drive, in response to being triggered to rotate to a door-opening position, a hook of the door body to be disengaged from a limiting portion of the casing. The first restoring member is connected to the flipping member and the casing respectively. The first restoring member is configured to provide the flipping member with a first restoring force for allowing the flipping member to rotate towards a non-triggered position. The restricting member is movably disposed on the casing between a first position in which the restricting member blocks the flipping member from rotating towards the door-opening position and a second position in which the restricting member avoids a rotation of the flipping member. The second restoring member is connected to the restricting member and the casing respectively. The second restoring member is configured to provide the restricting member with a second restoring force for allowing the restricting member to move towards the first position. The latching structure is configured such that under the first restoring force, a restoring speed at which the flipping member rotates towards the non-triggered position is greater than a restoring speed at which the restricting member moves from the second position towards the first position, to allow the restricting member to avoid restoration of the flipping member.

The latching structure for the cooking device according to the embodiments of the present disclosure can lock the door body. When opening the door body of the cooking device, it is necessary to first release the restriction of the latching structure and then open a switch lock to open the door body, which can avoid the problem that the child accidentally touches the switch lock apparatus to directly open the door body, and improve the safety of using the cooking device.

In addition, the latching structure for the cooking device according to the above embodiments of the present disclosure may have the following additional technical features.

According to some embodiments of the present disclosure, the latching structure for the cooking device further includes a damping member connected to the restricting member and the casing respectively. The damping member provides a damping force to reduce the restoring speed at which the restricting member moves towards the first position.

According to some embodiments of the present disclosure, the first restoring force is greater than the second restoring force such that the restoring speed of the flipping member is greater than the restoring speed of the restricting member.

According to some embodiments of the present disclosure, the restricting member includes a first abutting portion, and the flipping member includes a second abutting portion. When the restricting member is in the first position, the second abutting portion at least partially abuts on the first abutting portion. When the restricting member is in the second position, the second abutting portion and the first abutting portion are completely staggered with each other.

In some embodiments, the restricting member further includes a first avoiding portion corresponding to the second abutting portion. The first avoiding portion and the first abutting portion are staggered with each other. The flipping member further includes a second avoiding portion corresponding to the first abutting portion. The second avoiding portion and the second abutting portion are staggered with each other. When the restricting member is in the second position, the first abutting portion enters the second avoiding portion, and the second abutting portion enters the first avoiding portion.

In some embodiments, the latching structure for the cooking device further includes a support base disposed on the casing and connected to the second restoring member and the damping member respectively. The restricting member is movably engaged with the support base.

In some examples, the support base has one of a guide groove and a guide portion defined thereon. The restricting member has the other of the guide groove and the guide portion defined thereon. The guide portion extends into the guide groove. The restricting member is movable relative to the support base in an extending direction of the guide groove to switch between the first position and the second position.

In some embodiments, the support base includes a cover body and a bracket. An accommodating chamber for accommodating the damping member is formed between the cover body and the bracket.

According to some embodiments of the present disclosure, the latching structure for the cooking device further includes: a fixing base disposed on the casing and having a first guide groove running therethrough; a press button extending into the first guide groove and movable relative to the fixing base in a direction, in which the first guide groove runs through the fixing base, to push the restricting member to move.

In some embodiments, the button includes a first action member matching the first guide groove and having a pressing surface; and a force applying member connected to a surface of the first action member facing away from the pressing surface. The force applying member interacts with the restricting member to push the restricting member move.

In some examples, the first guide groove has a second guide groove defined on each of opposite side walls thereof. The press button further includes a guide member protruding relative to the first action member. The guide member extends into the second guide groove and is movable relative to the fixed base in an extending direction of the second guide groove.

In some embodiments, the latching structure for the cooking device further includes a disabling member detachably engaged with the fixing base. The disabling member is configured to press, in response to being engaged with the fixing base, the press button to cause the restricting member to be maintained in the second position against the second restoring force.

In some embodiments, the disabling member has an elastic protrusion provided thereon. The elastic protrusion is engaged with the second guide groove in such a manner that the disabling member is detachable relative to the fixing base.

In a second aspect, according to embodiments of the present disclosure, a cooking device is provided. The cooking device includes a casing having a limiting portion provided thereon; a door body engaged with the casing in an openable and closable manner and having a hook provided thereon; and the latching structure for the cooking device according to the embodiments of the present disclosure in the first aspect. The latching structure is disposed on the casing. The flipping member is engaged with the hook. The flipping member is configured to drive, in response to being triggered to rotate into the door-opening position, the hook to be disengaged from the limiting portion.

In the cooking device according to the embodiments of the present disclosure, the latching structure for the cooking device according to the embodiments of the present disclosure in the first aspect is used, so that the door body can be locked, and when the door body of the cooking device is opened, it is necessary to release the restriction of the latching structure first and then open the switch lock to open the door body. In this way, the problem that the child accidentally touches the switch lock apparatus to directly open the door body can be avoided, and the safety of using the cooking device is improved.

According to some embodiments of the present disclosure, the casing has a control box provided thereon. The control box is configured to control an operation state of the cooking device. The latching structure is located on a rear side of the control box.

According to some embodiments of the present disclosure, the casing has a door-opening button provided thereon. The door-opening button is configured to trigger the flipping member. The casing further has a press button provided on a side wall thereof adjacent to the door-opening button. The press button is configured to push the restricting member to move.

The present disclosure further provides a latching structure for a cooking device, which has the advantages of locking the door body, protecting children from being scalded due to accidental touch, having a relatively simple structure, and facilitating cost reduction.

The present disclosure further provides a cooking device having the latching structure for the cooking device.

In a third aspect, a latching structure for a cooking device is provided according to embodiments of the present disclosure. The cooking device includes a casing and a door body. The door body is engaged with the door body in an openable and closable manner. The latching structure includes: a flipping member, a base, a press button, and a restricting member. The flipping member is rotatably disposed on the casing. The flipping member is configured to rotatably drive, in response to being triggered to rotate into the door-opening position, a door hook of the door body to rotate so as to be disengaged from a limiting portion on the casing. The base is disposed on the casing. The press button is movably disposed on the base. The restricting member is engaged with the press button to move synchronously with the press button. The press button is configured to drive, when moving, the restricting member to move between a locking position and an unlocking position. When the restricting member is in the locking position, the restricting member is located on a rotation path of the flipping member to block the flipping member from rotating towards the door-opening position. When the restricting member is in the unlocking position, the restricting member avoids the flipping member.

The latching structure for the cooking device according to the embodiments of the present disclosure has the advantages of locking the door body, protecting a child from being scalded due to accidental touch, having a relatively simple structure, and facilitating cost reduction.

In addition, the latching structure for the cooking device according to the above embodiments of the present disclosure may further have the following additional technical features.

According to some embodiments of the present disclosure, the press button is rotatably disposed on the base. The press button is configured to drive, when rotating, the restricting member to switch between an enabled state and a disabled state. The press button is configured to move, when the restricting member is in the enabled state, to drive the restricting member to move between the locking position and the unlocking position. When the restricting member is in the disabled state, the restricting member avoids the flipping member.

According to some embodiments of the present disclosure, the latching structure for the cooking device further includes a first restoring member engaged with the restricting member and the base respectively. The first restoring member is configured to provide the restricting member with a torsion force for allowing the restricting member to rotate towards the enabled state.

According to some embodiments of the present disclosure, the base has a first limiting portion and a second limiting portion provided thereon. The first limiting portion is engaged with or disengaged from the restricting member. The second limiting portion is engaged with or disengaged from the restricting member. When the restricting member is in the enabled state, the first limiting portion is engaged with the restricting member to guide a moving direction of the restricting member. When the restricting member is in the disabled state, the second limiting portion is engaged with the restricting member to position the limiting member.

In some embodiments, the base has a first limiting post, a second limiting post, and a third limiting post provided thereon. The first limiting post, the second limiting post, and the third limiting post are arranged at intervals in a rotation direction of the press button. The first limiting portion is defined by the first limiting post and the second limiting post, and the second limiting portion is defined by the second limiting post and the third limiting post.

In some embodiments, the base includes: a cover body having a pressing hole; and a fixing base fixed on the cover body. The press button is disposed in the cover body and directly opposite to the pressing hole. The press button partially extends through the fixing base to be engaged with the restricting member. The first limiting portion and the second limiting portion are disposed on a side wall of the fixing base facing away from the cover body.

According to some embodiments of the present disclosure, the press button has a pressing surface with an insertion hole. The latching structure further includes a key that is in insertion fit with the insertion hole. When the key is engaged with the insertion hole, rotation of the key drives the press button to rotate.

According to some embodiments of the present disclosure, the latching structure for the cooking device further includes a second restoring member connected to the press button and the base respectively. The second restoring member is configured to provide a restoring force to the press button to allow the restricting member to move into the locking position.

According to some embodiments of the present disclosure, the latching structure for the cooking device further includes a third restoring member connected to the flipping member and the casing. The third restoring member is configured to provide the flipping member with a restoring force for allowing the flipping member to rotate towards a non-triggered position.

In some examples, the latching structure is configured such that the flipping member blocks the restricting member from moving towards the locking position during a rotation of the flipping member towards the non-triggered position; or the latching structure is configured such that the restricting member avoids the rotation of the flipping member during the rotation of the flipping member towards the non-triggered position.

In some embodiments, the flipping member has an abutting-stopping portion and an avoidance space provided thereon. The abutting-stopping portion and the avoidance space are disposed in sequence in a moving direction of the press button. When the restricting member is in the locking position and the flipping member is triggered, the restricting member abuts on the abutting-stopping portion and is stopped by the abutting-stopping portion. When the restricting member is in the unlocking position, the restricting member directly faces the avoidance space.

In some examples, the latching structure for the cooking device further includes a second restoring member and a third restoring member. The second restoring member is connected to the press button and the base respectively. The second restoring member is configured to provide a restoring force to the press button to allow the restricting member to move into the locking position. The third restoring member is connected to the flipping member and the casing. The third restoring member is configured to provide the flipping member with a restoring force for allowing the flipping member to rotate towards a non-triggered position. When the flipping member rotates towards the non-triggered position, the second restoring member pulls the press button in such a manner that the restricting member is brought into contact with a side wall of the abutting-stopping portion facing towards the avoidance space until the restricting member directly faces the abutting-stopping portion.

In a fourth aspect, a cooking device is provided according to embodiments of the present disclosure. The cooking device includes a casing having a limiting portion provided thereon; a door body connected to the casing in an openable and closable manner, the door body having a door hook provided thereon, and the door hook being engaged with or disengaged from the limiting portion; and the latching structure for the cooking device according to the embodiments of the present disclosure in the third aspect. The latching structure is disposed on the casing, and the flipping member is engaged with the door hook.

According to some embodiments of the present disclosure, the casing has a control box provided thereon. The control box is configured to control an operation state of the cooking device, and the latching structure is located on a rear side of the control box.

According to some embodiments of the present disclosure, the casing has a door-opening button provided thereon. The door-opening button is configured to trigger the flipping member. The casing further has a press button provided on a side wall thereof adjacent to the door-opening button.

In the cooking device according to the embodiments of the present disclosure, the latching structure of the cooking device according to the embodiments of the present disclosure in the first aspect is used. The cooking device has the advantages of locking the door body, protecting children from being scalded due to accidental touch, having a relatively simple structure, and facilitating cost reduction.

Additional aspects and advantages of embodiments of the present disclosure will be set forth, in part, in the following description, and in part will be apparent from the following description, or learned by practice of embodiments of the present disclosure.

BRIEF DESCRIPTION OF DRAWINGS

The above and/or additional aspects and advantages of the present disclosure will become apparent and readily understood from the following description of embodiments in conjunction with the accompanying drawings, in which.

REFERENCE NUMERALS

Figure 1:
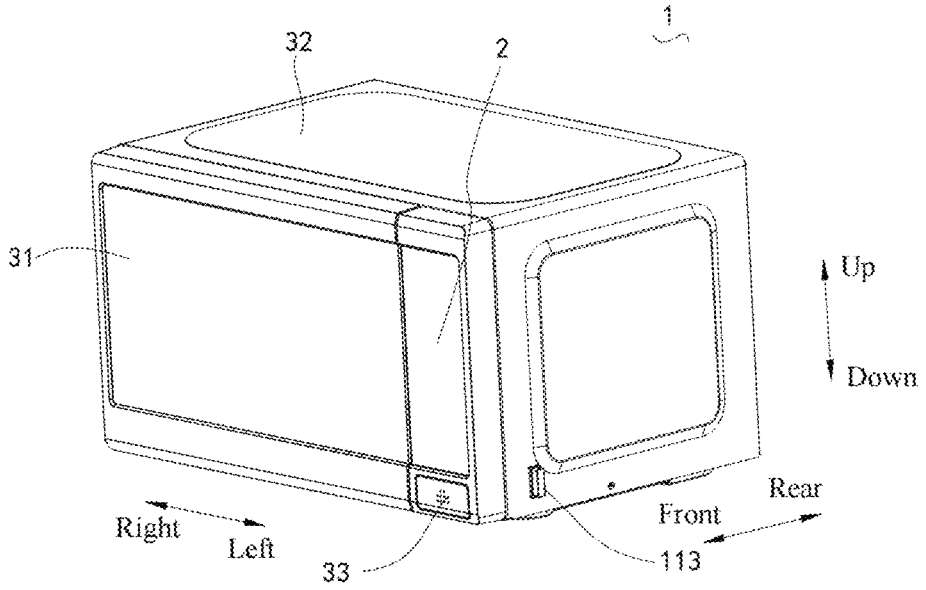
FIG. 1 is a schematic diagram of a three-dimensional structure of a cooking device according to embodiments of the present disclosure.
Figure 2:
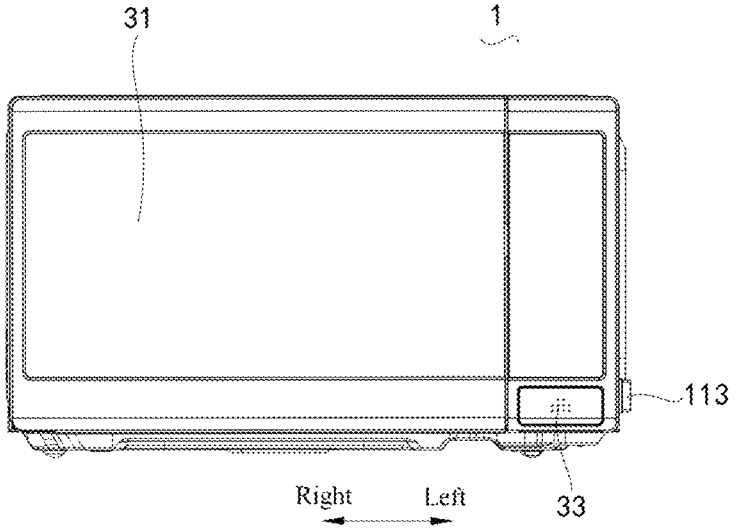
FIG. 2 is a schematic planar view of the cooking device shown in FIG. 1.

Cooking device 1, control box 2, latching structure 10, casing 32, limiting portion 21, rotating member 22, door body 31, door hook 312, door-opening button 33, flipping member 100, abutting-stopping portion 110, avoidance space 120, base 200, first limiting portion 201, second limiting portion 202, cover body 210, pressing hole 211, snap hole 212, fixing base 220, first limiting post 221, second limiting post 222, third limiting post 223, mounting groove 2331, snap portion 224, press button 111, pressing surface 310, insertion hole 311, restricting member 12, mounting hole 410, first abutting portion 121, first avoiding portion 122, snap groove 1231, guide portion 124, first restoring member 14, first restoring member 520, second restoring member 15, third restoring member 530, circlip 540, first action member 1111, force applying member 1112, guide member 1113, fixing base 112, first guide groove 1123, second guide groove 1124, disabling member 113, operation portion 1131, engaging portion 1132, elastic protrusion 1133, support base 130, cover body 131, bracket 132, accommodating chamber 1323, damping member 133, head portion 1331, rod portion 1332, guide groove 134, flipping member 20, second abutting portion 221, and second avoiding portion 222.

DESCRIPTION OF EMBODIMENTS

The embodiments of the present disclosure will be described in detail below, examples of the embodiments are illustrated in the accompanying drawings, throughout which the same or similar reference numerals refer to the same or similar elements or elements having the same or similar functions. The embodiments described below with reference to the accompanying drawings are exemplary and are only used to explain the present disclosure, but should not be construed as limiting the present disclosure.

A latching structure 10 for a cooking device 1 and the cooking device 1 according to the embodiments of the present disclosure are described below with reference to FIGS. 1 to 10.

As illustrated in FIGS. 1 to 10, the latching structure 10 for the cooking device 1 according to the embodiments of the present disclosure is provided. The cooking device 1 includes a casing 32 and a door body 31. The latching structure 10 includes a flipping member 20, a first restoring member 14, a restricting member 12, and a second restoring member 15.

The door body 31 fits with the casing 32 in an openable and closable manner, so that the casing 32 can be opened and closed through the door body 31. When a user needs to use the cooking device 1, the door body 31 can be operated to open the casing 32, food can be placed in the casing 32, then the casing 32 can be closed through the door body 31, and the food can be cooked in the cooking device 1.

The flipping member 20 is rotatably disposed on the casing 32. In response to being triggered to rotate to a door-opening position, the flipping member 20 drives a hook of the door body 31 to be disengaged from a limiting portion of the casing 32, and at this moment the casing 32 can be opened through the door body 31.

That is to say, the user can change the engagement relation between the hook and the limiting portion by operating the flipping member 20, and then the door body 31 can be moved from a position in which the casing 32 is closed to a position in which the casing 32 is opened. In this way, the casing 32 can be closed or opened as required by the user. When the casing 32 is closed by the door body 31, the hook on the door body 31 is engaged with the limiting portion on the casing 32, to ensure that the door body 31 is in a state in which the casing 32 is closed. After the user operates the flipping member 20, the hook on the door body 31 can be disengaged from the limiting portion on the casing 32, and the door body 31 can move to the position in which the casing 32 is opened.

The first restoring member 14 is respectively connected to the flipping member 20 and the casing 32, and the first restoring member 14 can provide the flipping member 20 with a first restoring force for allowing the flipping member 20 to rotate towards a non-triggered position, so as to ensure that after the user releases the flipping member 20, the flipping member 20 can be automatically restored to the non-triggered position, which is convenient for the user to operate the flipping member 20 next time.

Figure 3:
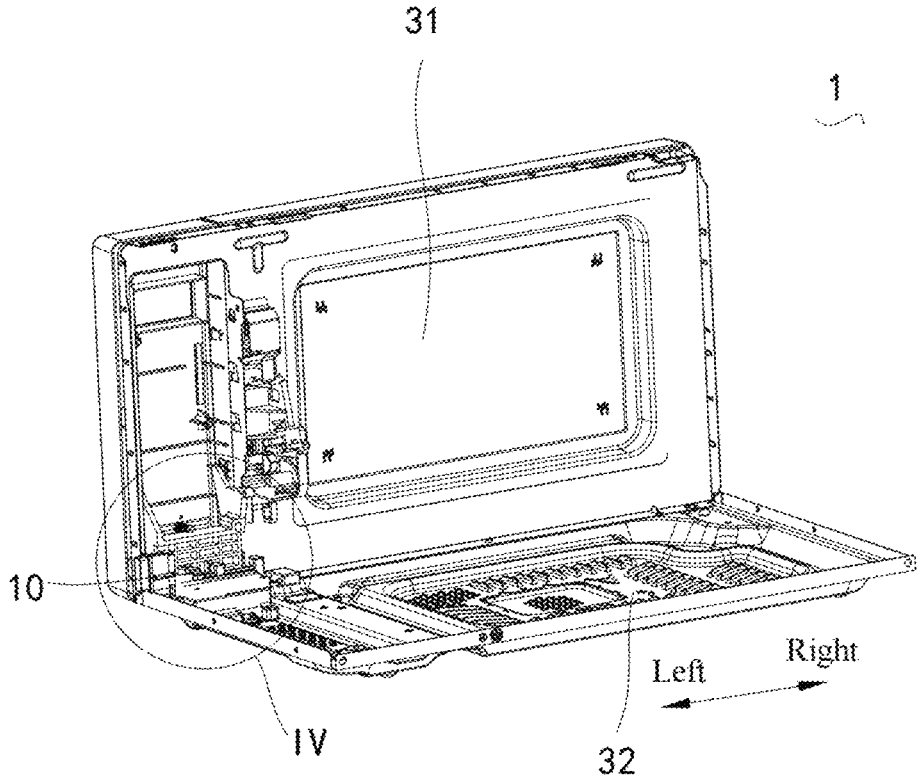
FIG. 3 is a schematic diagram of a partial three-dimensional structure of the cooking device shown in FIG. 1.
Figure 4:
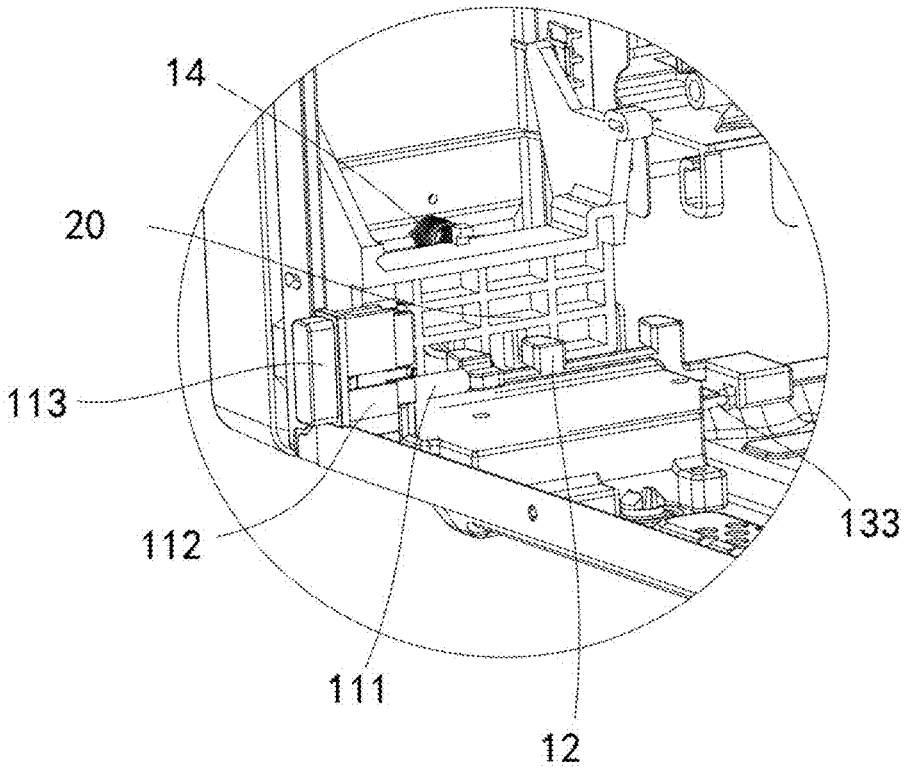
FIG. 4 is an enlarged view of a region IV of the cooking device shown in FIG. 3.
Figure 5:
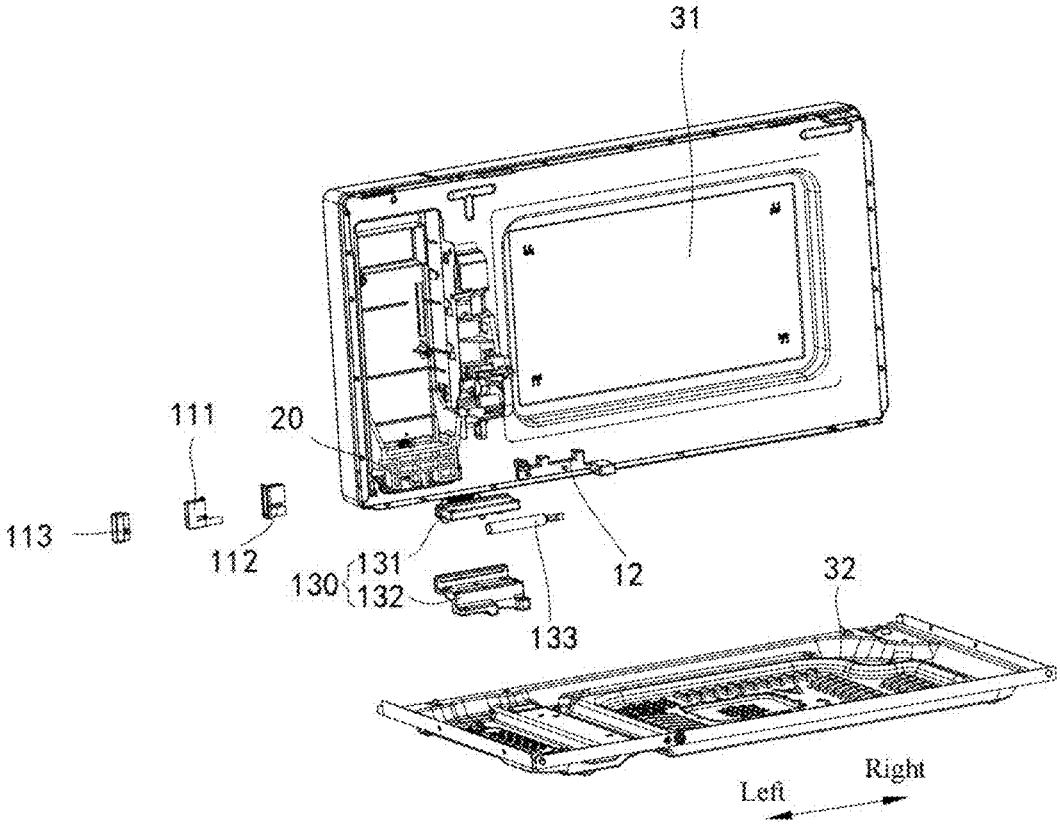
FIG. 5 is a partially exploded schematic diagram of the cooking device shown in FIG. 3.

Referring to FIGS. 3 to 5, the restricting member 12 can be movably disposed on the casing 32 between a first position and a second position. When the restricting member 12 is in the first position, the restricting member 12 blocks the flipping member 20 from rotating towards the door-opening position, and when the user operates the flipping member 20, since the restricting member 12 blocks a rotation of the flipping member 20 and the hook of the door body 31 and the limiting portion on the casing 32 are still in an engaged state, the door body 31 cannot move to the position in which the casing 32 is opened.

When the restricting member 12 is in the second position, the restricting member 12 can avoid the rotation of the flipping member 20. When the user operates the flipping member 20, the flipping member 20 can move to the door-opening state, thereby the flipping member 20 drives the hook of the door body 31 to be disengaged from the limiting portion on the casing 32, and at this moment the door body 31 can move to the position where the casing 32 is opened.

The provided latching structure 10 can realize double locking of the door body 31. When the casing 32 needs to be opened through the door body 31, the user needs to move the restricting member 12 to the second position, and move the flipping member 20 to the door-opening state. The casing 32 can be opened only through step-by-step operations, so as to protect a child from being scalded by accidentally touching and opening the casing 32.

Figure 8:
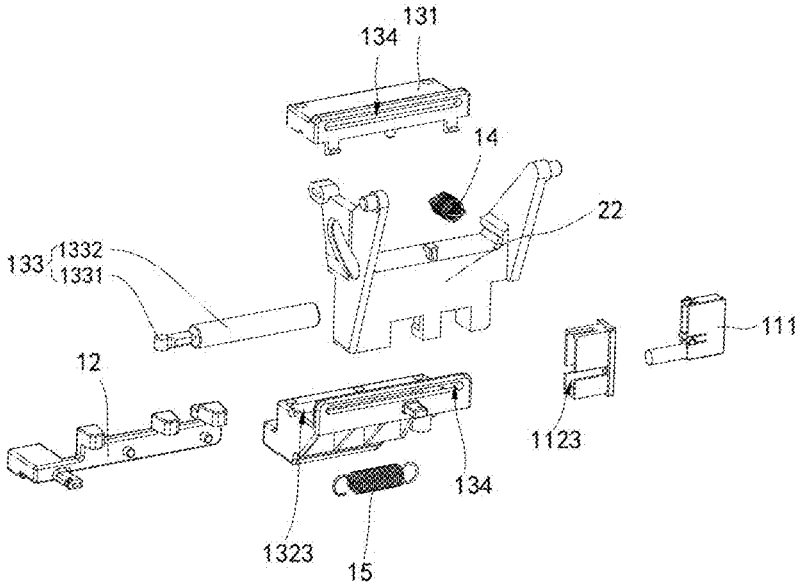
FIG. 8 is an exploded schematic diagram of a latching structure for the cooking device shown in FIG. 1.

Referring to FIGS. 5 and 8, the second restoring member 15 is respectively connected to the restricting member 12 and the casing 32, and the second restoring member 15 is configured to provide the restricting member 12 with a second restoring force for allowing the restricting member 12 to move towards the first position, so that the restriction member 12 can always block the flipping member 20 from moving towards the door-opening position, and each time, a press button 111 needs to be operated to move the restricting member 12 to the second position. It facilitates realizing that the door body 31 is opened only through step-by-step operations, and a case where the door body 31 is opened due to accidental touch is avoided.

The latching structure 10 is configured such that a restoring speed at which the flipping member 20 is rotated by the first restoring force towards the non-triggered position is greater than a restoring speed at which the restricting member 12 moves from the second position towards the first position, to allow the restricting member 12 to avoid the restoration of the flipping member 20, and to prevent the restricting member 12 from blocking a rotation of the flipping member 20 towards the non-triggered position when the restricting member 12 moves from the second position to the first position, so as to prevent the restricting member 12 and the flipping member 20 from being stuck during the movement. That is to say, when the casing 32 needs to be opened, the user can first move the restricting member 12 to the second position, and then operate the flipping member 20 to move to the door-opening state. When the user releases the flipping member 20 and the restricting member 12 at the same time, the flipping member 20 is preferentially restored to the non-triggered position under the driving of the first restoring member 14, and the restricting member 12 can smoothly be restored to the first position after the flipping member 20 is restored to the non-triggered position, and the restricting member 12 and the flipping member 20 do not block each other during the restoring.

With the latching structure 10, on the one hand, when opening the door body 31 of the cooking device 1, the user needs to operate on the restricting member 12 first in order to release the restriction on the flipping member 20. Then, the flipping member 20 is operated to release the restriction between the hook and the limiting portion to open the door body 31. In this way, the problem that a child accidentally touches the latching structure 10 to directly open the door body 31 can be avoided, and the safety of using the cooking device 1 is improved. On another hand, the latching structure 10 according to the embodiments of the present disclosure has a simple structure and low cost, which is beneficial to simplify the manufacturing process of the cooking device 1 and can also reduce the manufacturing cost of the cooking device 1. Furthermore, the latching structure 10 according to the embodiments of the present disclosure is convenient to operate, is convenient for the user to use, and has a better user experience.

Therefore, the latching structure 10 of the cooking device 1 according to the embodiments of the present disclosure can lock the door body 31. It is necessary to first release the restriction of the latching structure 10 and then open the switch lock before opening the door body 31 of the cooking device 1. In this way, the problem that a child accidentally touches the switch lock apparatus to directly open the door body 31 can be avoided, and the safety of using the cooking device is improved The latching structure 10 of the cooking device 1 according to specific embodiments of the present disclosure will be described below with reference to the accompanying drawings.

As shown in FIGS. 1 to 10, the cooking device 1 includes a casing 32 and a door body 31, and the latching structure 10 includes a flipping member 20, a first restoring member 14, a restricting member 12 and a second restoring member 15.

For example, cooking devices 1 such as microwave ovens, electric steam ovens, and electric ovens have become commonly used electrical appliance in contemporary family life. When heating of the food in the cooking device 1 is completed, the food is at a high temperature. At present, most cooking devices 1 can be opened by pulling a door handle or pressing a press button 111, and a force for opening the door of the cooking device is within 25N. Under this mechanism, for a family with a child, during use of the cooking device 1, the child may accidentally touch the press button 111 or handle, the door can be opened by lightly pressing or pulling, and there is a risk of the child being scalded by the heated food. In order to solve the above problem, reference can be made to FIGS. 1 to 3, embodiments of the present disclosure provide a latching structure 10 for a cooking device 1.

In some embodiments of the present disclosure, the door body 31 is rotatably connected to the casing 32, and the door body 31 is rotatable relative to the casing 32 to open or close the casing 32. The door body 31 and the casing 32 can be rotatably connected through, but not limited to a hinged manner, as long as the door body 31 and the casing 32 can be rotatably connected together. In addition, in some embodiments, the door body 31 can be connected to the casing 32 in a non-detachable manner, so that the cooking device 1 has a good structural integrity, a firm installation, and a beautiful appearance. In some other embodiments, the door body 31 can be detachably connected to the casing 32, so that if a structure in the casing 32 is damaged, the door body 31 can be disassembled from the casing 32 for maintenance.

In some embodiments of the present disclosure, the first restoring member 14 is a tension spring, and the user can press the flipping member 20 to rotate the flipping member 20 backward (forward and backward directions are shown in FIG. 1). At this moment, the first restoring member 14 is elastically deformed and elongated. When the user releases the first restoring member 14, the first restoring member 14 can pull the flipping member 20 with a large pulling force so that the flipping member 20 rotates forward. The first restoring member 14 always applies a forward pulling force on the flipping member 20, to ensure that after the user releases the flipping member 20, the first restoring member 14 can always have a sufficient force for driving the flipping member 20 to be restored back to the non-triggered position. In this way, the user can directly operate the flipping member 20 next time.

In some embodiments of the present disclosure, the second restoring member 15 is a compression spring, and the user can drive the restricting member 12 to move rightward. At this moment, the second restoring member 15 is elastically deformed and compressed. After the user releases the second restoring member 15, the second restoring member 15 can push the restricting member 12 with a larger thrust so that the restricting member 12 moves leftward. The second restoring member 15 always applies a leftward thrust on the restricting member 12 (leftward and rightward directions are shown in FIG. 1), to ensure that after the restricting member 12 is not operated, the second restoring member 15 can always have a sufficient force to drive the restricting member 12 to move to the first position, and the restricting member 12 can always block the movement of the flipping member 20 towards the door-opening position. In this way, the user needs to perform two operations to open the casing 32.

In some embodiments of the present disclosure, the latching structure 10 for the cooking device 1 further includes a damping member 133. The damping member 133 is respectively connected to the restricting member 12 and the casing 32. The damping member 133 provides a damping force to reduce the restoring speed at which the restricting member 12 moves towards the first position, thereby prolonging the restoring time of the restricting member 12. During a period of time during which the restricting member 12 moves from the second position to the first position, the flipping member 20 can be restored to the non-activated position.

In some embodiments, the user may first move the restricting member 12 from the first position to the second position, and after the user releases the restricting member 12, under the blocking of the damping member 133, the second restoring member 15 will not immediately drive the restricting member 15 to be restored to the first position, but instead stays in the first position for a period of time. During this period of time, the user can operate the flipping member 20 to rotate the flipping member 20 to the door-opening position and open the casing 32.

With the damping member 133, it facilitates reducing the user's difficulty in operation. For example, when the user can only operate the latching structure 10 with one hand, the setting of the damping member 133 can realize the step-by-step operations in different time periods. That is to say, there is no need to operate the restricting member 12 and the flipping member 20 at the same time. With one hand, the restricting member 12 can be operated first, and then the flipping member 20 can be operated to rotate the flipping member 20 to the door-opening position, to open the casing 32.

In some embodiments of the present disclosure, the first restoring force is greater than the second restoring force, so that a restoring speed at which the flipping member 20 rotates towards the non-triggered position is greater than a restoring speed at which the restricting member 12 moves from the second position to the first position. In this way, the restricting member 12 can avoid the rotation of the flipping member 20, and the restricting member 12 is prevented from blocking a rotation of the flipping member 20 towards the non-triggered position when the restricting member 12 moves from the second position towards the first position, so as to avoid the restricting member 12 and the flipping member 20 from being stuck during the movement.

In some embodiments of the present disclosure, as illustrated in FIGS. 5 to 7 and 10, the restricting member 12 includes a first abutting portion 121, and the flipping member 20 includes a second abutting portion 221. When the restricting member 12 is in the first position, the second abutting portion 221 at least partially abuts on the first abutting portion so that the restricting member 12 can block the rotation of the flipping member 20, the hook of the door body 31 and the limiting portion on the casing 32 are still in an engaged state, and the door body 31 cannot be moved to the position where the casing 32 is opened.

In the second position, the second abutting portion 221 and the first abutting portion 121 are completely staggered with each other, so that the restricting member 12 can avoid the rotation of the flipping member 20, and the flipping member 20 can smoothly rotate to the door-opening position.

In some specific embodiments of the present disclosure, the restricting member 12 further includes a first avoiding portion 122 corresponding to the second abutting portion 221. The first avoiding portion 122 and the first abutting portion 121 are staggered with each other. The flipping member 20 further includes a second avoiding portion 222 corresponding to the first abutting portion 121. The second avoiding portion 222 and the second abutting portion 221 are staggered with each other. When the restricting member 12 is in the second position, the first abutting portion 121 enters the second avoiding portion 222, and the second abutting portion 221 enters the first avoiding portion 122, so that the restricting member 12 can avoid the rotation of the flipping member 20.

It should be noted that one or more first abutting portions 121 and one or more first avoiding portions 122 may be provided, which is not limited here. Correspondingly, one or more second abutting portions 221 and one or more second avoiding portions 222 may be provided, which is not limited here. In addition, the "first abutting portion 121 entering the second avoiding portion 222" here may mean that the first abutting portion 121 only enters but does not pass through the second avoiding portion 222, or that the first abutting portion 121 enters and passes through the second avoiding portion 222. Similarly, "the second abutting portion 221 entering the first avoiding portion 122" may mean that the second abutting portion 221 only enters but does not pass through the first avoiding portion 122, or that the second abutting portion 221 enters and passes through the first avoiding portion 122, which is not limited here. In this way, by provision of the first avoiding portion 122 corresponding to the second abutting portion 221 and the second avoiding portion 222 corresponding to the first abutting portion 121, when the restricting member 12 is in the second position, the second abutting portion 221 can pass through the first avoiding portion 122, the first abutting portion 121 can pass through the second avoiding portion 222, and the flipping member 20 can rotate freely without being blocked.

Figure 10:
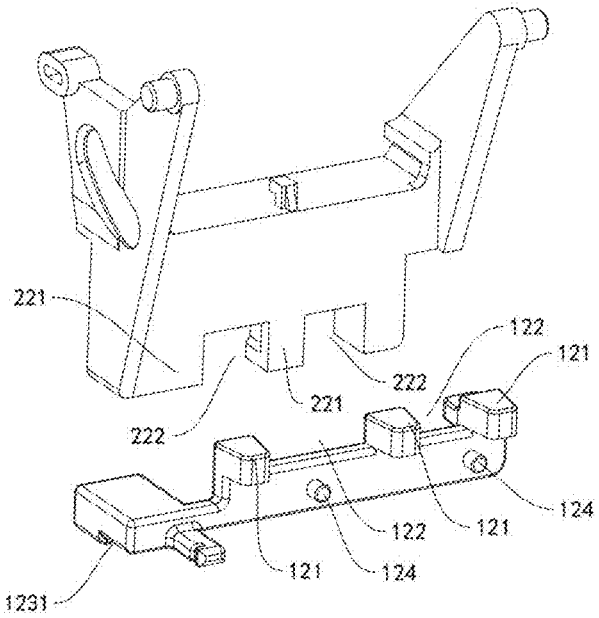
FIG. 10 is a schematic structural diagram of a flipping member and a restricting member in the cooking device shown in FIG. 1.

In some specific embodiments, as illustrated in FIG. 10, the restricting member 12 includes three first abutting portions 121 arranged and spaced apart from each other in a left-right direction. Every two adjacent first abutting portions 121 define one first avoiding portion 122. That is to say, the restricting member 12 has two first avoiding portions 122 provided thereon. Correspondingly, the flipping member 20 has three second abutting portions 221 provided thereon. The three second abutting portions 221 are arranged and spaced apart from each other in the left-right direction. Every two adjacent second abutting portions 221 define one second avoiding portion 222. That is, the flipping member 20 has two second avoiding portions 222 provided thereon.

The restricting member 12 is movable in the left-right direction to move between the first position and the second position. When the restricting member 12 is in the first position, a position of the first abutting portion 121 corresponds to a position of the second abutting portion 221, and a position of the first avoiding portion 122 corresponds to a position of the second avoiding portion 222, so as to block the flipping member 20 through the cooperation of the first abutting portion 121 and the second abutting portion 221.

When the restricting member 12 moves to the right to the second position, the first abutting portion 121 and the second abutting portion 221 both move to the right by a certain distance, so that the position of the first abutting portion 121 corresponds to the position of the second avoiding portion 222, and the position of the second abutting portion 221 corresponds to the position of the first avoiding portion 122. When the user operates the flipping member 20, the second avoiding portion 222 can avoid the first abutting portion 121 and the first avoiding portion 122 can avoid the second abutting portion 221. At this moment, the flipping member 20 can rotate smoothly to the door-opening position.

In some embodiments of the present disclosure, as illustrated in FIGS. 5 and 8, the latching structure 10 for the cooking device 1 further includes a support base 130. The support base 130 is disposed on the casing 32 and connected to the second restoring member 15 and the damping member 133 respectively. The support base 130 can limit the positions of the damping member 133 and the second restoring member 15.

The restricting member 12 is movably engaged with the support base 130, and the support base 130 can limit the position of the restricting member 12, to prevent the restricting member 12 from disengaging from the support base 130 when the restricting member 12 moves between the first position and the second position.

In some optional embodiments of the present disclosure, the support base 130 has a guide groove 134 defined therein. The restricting member 12 has a guide portion 124. The guide portion 124 extends into the guide groove 134, and the restricting member 12 is movable in an extending direction of the guide groove 134 relative to the support base 130. In this way, through the engagement between the guide portion 124 and the guide groove 134, the restricting member 12 is movable relative to the support base 130 along a predetermined movement track.

Since the support base 130 is fixed relative to the casing 32, and the guide groove 134 is defined in the support base 130, which can make the structure of the guide groove 134 more stable, make the engagement between the guide portion 124 and the guide groove 134 more stable, and facilitate the smooth switching of the restricting member 12 between the first position and the second position.

In some embodiments, as illustrated in FIG. 8, the guide groove 134 on the support base 130 extends in the left-right direction (the left-right direction is shown in FIG. 1). Referring to FIG. 10, the restricting member 12 has a guide portion 124 provided on a side thereof facing towards the support base 130. The guide portion 124 is formed as a protrusion extending towards the guide groove 134. The guide portion 124 can extend into the guide groove 134, and is movable along the guide groove 134 in the left-right direction, to realize the smooth movement of the restricting member between the first position and the second position.

In some other optional embodiments of the present disclosure, the support base 130 has a guide portion 124 formed thereon. The restricting member 12 has a guide groove 134 defined therein. The guide portion 124 extends into the guide groove 134, and the restricting member 12 is movable in an extending direction of the guide groove 134 relative to the support base 130. In this way, through the engagement between the guide portion 124 and the guide groove 134, the restricting member 12 is movable relative to the support base 130 along a predetermined movement track.

It should be noted that one or more guiding portions 124 may be provided, which is not limited here. In the embodiment illustrated in FIG. 3, two guide portions 124 are provided. The provision of a plurality of guide portions 124 facilitates to enhance the stability of the engagement between the restricting member 12 and the support base 130, so that the support base 130 can move smoothly between the first position and the second position.

In addition, a length of the guide groove 134 can limit a movable range of the restricting member 12. When a movable path of the restricting member 12 needs to be shortened, the length of the guide groove 134 can be shortened, which facilitates the miniaturization design of the latching structure 10.

In some embodiments of the present disclosure, as illustrated in FIGS. 5 and 8, the support base 130 includes a cover body 131 and a bracket 132. An accommodating chamber 1323 is formed between the cover body 131 and the bracket 132. The accommodating chamber 1323 is configured to accommodate the damping member 133 to limit the position of the damping member 133. Since the damping member 133 is connected to the restricting member 12, and the damping member 133 is disposed in the accommodating chamber 1323, the restricting member 12 is prevent from driving the damping member 133 to move when the restricting member 12 moves. In this way, the position of the damping member 133 can be limited, ensuring that the damping member 133 can always provide a damping force to reduce the restoring speed of the restricting member 12 moving towards the first position.

In some embodiments, as illustrated in FIGS. 8 and 10, the damping member 133 has a head portion 1331 and a rod portion 1332. The restricting member 12 has a snap groove 1231. The rod portion 1332 is accommodated in the accommodating chamber 1323 that is defined by the bracket 132 and the cover body 131. The rod portion 1332 is positioned fixedly relative to the bracket 132 and the cover body 131. The head portion 1331 protrudes out of the accommodating chamber 1323. The head portion 1331 can extend into the snap groove 1231 of the restricting member 12. The head portion 1331 is elastically engaged with the snap groove 1231.

In some examples, when the restricting member 12 is in the first position, the head portion 1331 is exposed outside the snap groove 1231. When the restricting member 12 is in the second position, the head portion 1331 extends into the snap groove 1231. That is, when the user moves the restricting member 12 from the first position to the second position, the head portion 1331 is gradually engaged with the snap groove 1231. At this moment, the user needs to apply a certain force to overcome the damping force of the damper 133 on the restricting member 12, so that the restricting member 12 can move to the second position. The user generally will not apply a large force on the restricting member 12 when the user has an accidental touch, and the provision of the damping member 133 can further avoid the movement of the restricting member 12 caused by the user's accidental touch.

When the user releases the restricting member 12, the second restoring force caused under the driving of the second restoring member 15 gradually overcomes the damping force caused by the damping member 133, so that the restricting member 12 is restored to the first position, and the head portion 1331 is gradually disengaged from the snap groove 1231.

In some embodiments, the bracket 132 can be fixed to the casing 32 by means of screw connection and/or snap connection. The cover body 131 is fixedly mounted on the bracket 132 by means of screw connection and/or snap connection, so as to stably fix the support base 130 on the casing 32. As illustrated in FIGS. 5 and 8, the guide groove 134 may be formed on the bracket 132 and/or the cover 131 to prevent the bracket 132 and/or the cover body 131 from blocking the movement of the restricting member 12.

Figure 6:
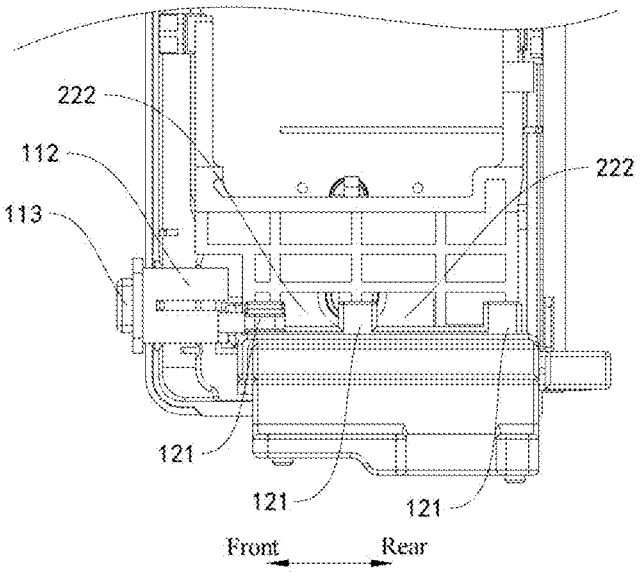
FIG. 6 is a schematic diagram of a restricting member in a position where the restricting member blocks a rotation of a flipping member in the cooking device shown in FIG. 1.
Figure 7:
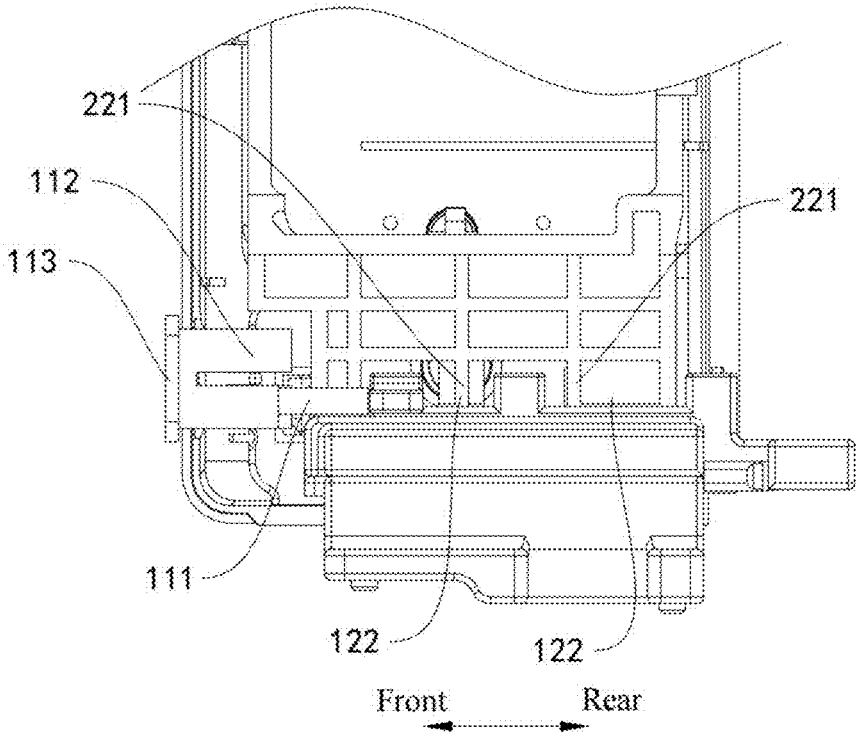
FIG. 7 is a schematic diagram of a restricting member in a position where a restricting member avoids a rotation of a flipping member in the cooking device shown in FIG. 1.

In some embodiments of the present disclosure, as illustrated in FIGS. 4 to 6, the latching structure 10 for the cooking device 1 further includes a fixing base 112 and a press button 111. The fixing base 112 has a first guide groove 1123 running therethrough. The fixing base 112 is disposed on the casing 32. The press button 111 extends into the first guide groove 1123. The press button 111 is movable relative to the fixing base 112 in a direction, in which the first guide groove 1123 runs through the fixing base 112, to push the restricting member 12 to move. The user can operate the press button 111 to operate on the movement of the restricting member 12, to realize the movement of the restricting member 12 between the first position and the second position, thereby improving the operation comfort of the user.

In some embodiments, the direction in which the first guide groove 1123 runs through the fixing base 112 extends in the left-right direction, so that the press button 111 is movable in the left-right direction so as to push the restricting member 12 to move in the left-right direction, thereby realizing the smooth movement of the restricting member 12 between the first position and the second position.

Figure 9:
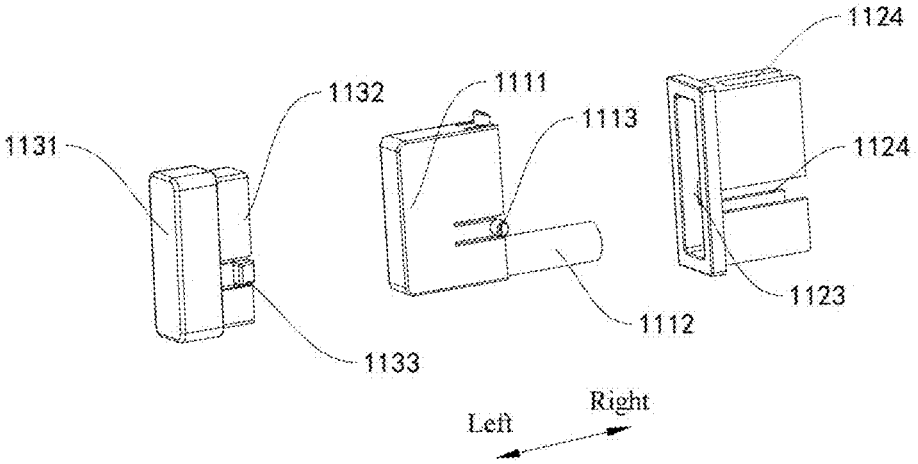
FIG. 9 is a schematic structural diagram of a press button, a fixing base and a disabling member in the cooking device shown in FIG. 1.

In some optional embodiments of the present disclosure, as illustrated in FIGS. 8 to 9, the press button 111 includes a first action member 1111 and a force applying member 1112. The first action member 1111 matches the first guide groove 1123, and the first guide groove 1123 can limit a moving direction of the first action member 1111 and further limit a moving direction of the press button 111. When the press button 111 is stressed, the press button 111 can move along a predetermined movement track to avoid a problem that the movement of the press button 111 deviates from the predetermined movement track, resulting in that the restricting member 12 cannot be pushed to move along a predetermined route. In this way, it is ensured that the restricting member 12 can move smoothly in a predetermined direction.

The first action member 1111 has a pressing surface. The force applying member 1112 is connected to a surface of the first action member 1111 facing away from the pressing surface. The force applying member 1112 interacts with the restricting member 12 to push the restricting member 12 to move. The pressing surface is configured to contact the user, to receive the user's operation. That is to say, the user can drive the first action member 1111 to move through the pressing surface, and then the first action member 1111 drives the force applying member 1112 to move. Since the force applying member 1112 interacts with the restricting member 12, the force applying member 1112, when moving, can drive the restricting member 12 to move. In this way, it is ensured that the restricting member 12 can move from the first position to the second position under the operation of the user.

In some embodiments, as illustrated in FIGS. 8 and 9, the force applying member 1112 is located at an end of the first action member 1111 facing away from a rotation axis of the flipping member 20. In this way, a case where the rotation path of the flipping member 20 is blocked by the force applying member 1112 is avoided, so as to make the force applying member 1112 better avoid the rotation path of the flipping member 20.

In some optional embodiments of the present disclosure, the first guide groove 1123 has a second guide groove 1124 defined on each of opposite side walls thereof. The press button 111 further includes a guide member 1113 protruding relative to the first action member 1111. The guide member 1113 extends into the second guide groove 1124 and is movable relative to the fixing base 112 in an extending direction of the second guide groove 1124. On the one hand, the provision of the second guide groove 1124 can limit the position of the press button 111, and prevent the press button 111 from falling from the fixing base 112. On the other hand, the provision of the second guide groove 1124 can ensure that the press button 111 can move stably in the extending direction of the second guide groove 1124 under the operation of the user.

In some embodiments, as illustrated in FIG. 9, the direction in which the first guide groove 1123 runs through the fixing base 112 extends in the left-right direction. The opposite side walls of the first guide groove 1123 include upper and lower side walls and front and rear side walls of the fixing base 112 (the up-down direction and the front-rear direction are shown in FIG. 1, and it should be understood here that the above direction limitations are only for facilitating the description of the drawings, and do not limit the actual setting position and direction of the latching structure 10 for the cooking device 1). One or more side walls in the upper and lower side walls and the front and rear side walls of the fixing base 112, or all side walls of the fixing base 112 has a second guide groove 1124 defined therein, and the second guide groove 1124 extends in the left-right direction.

The press button 111 has a guide member 1113 provided on a corresponding position. When the first action member 1111 on the press button 111 is installed in the first guide groove 1123, the guide member 1113 on the press button 111 is correspondingly installed in the second guide groove 1124. The first guide groove 1123 and the second guide groove 1124 jointly limit the moving direction of the press button 111 to ensure the smooth movement of the press button 111 and thus the smooth movement of the restricting member 12.

In some optional embodiments of the present disclosure, as illustrated in FIGS. 4 to 7, the latching structure 10 for the cooking device 1 further includes a disabling member 113. The disabling member 113 is detachably engaged with the fixing base 112. The disabling member 113 presses, in response to being engaged with the fixing base 112, the press button 111 to cause the restricting member 12 to be maintained in the second position against the second restoring force. In this case, the user can rotate the flipping member 20 to the door-opening state without operating the restricting member 12, to adapt to the different needs of different users.

When the user does not need to restrict the rotation of the flipping member 20, the disabling member 113 can be installed on the fixing base 112. In this case, the restricting member 12 is fixed in the second position, and the user can operate the flipping member 20 at any time to open the door body 31.

When the user needs to restrict the rotation of the flipping member 20, the disabling member 113 can be removed from the fixing base 112. The second restoring member 15 drives the restricting member 12 to be restored to the first position, so as to drive the press button 111 to be restored in an initial position. In this case, the restricting member 12 can block the flipping member 20 from rotating to the door-opening position.

In some specific embodiments of the present disclosure, the disabling member 113 has an elastic protrusion 1133 provided thereon. The elastic protrusion 1133 is engaged with the second guide groove 1124 in such a manner that the disabling member 113 is detachable relative to the fixing base 112, which is convenient for the user to operate the disabling member 113 to change the position of the press button 111 so as to change the position of the restricting member 12 and adjust the restricting state of the restricting member 12 on the flipping member 20.

In some embodiments, the direction in which the first guide groove 1123 runs through the fixing base 112 extends in a front-rear direction, and the restricting member 12 is movable between the first position and the second position in the front-rear direction. The press button 111 is disposed in the first guide groove 1123 of the fixing base 112. When the restricting member 12 is in the first position, a left end surface of the press button 111 is flush with a left end surface of the fixing base 112. When the user installs the disabling member 113 in the first guide groove 1123 in the left-right direction, the disabling member 113 drives the press button 111 to move to the right, and drives the restricting member to move to the right.

When the disabling member 113 is installed in place, the elastic protrusion 1133 on the disabling member 113 is engaged in place with the second guide groove 1124 and the disabling member 113 is fixed in that place. In this case, the restricting member 12 is in the second position and is fixed in the second position, and no longer restricts the rotation of the flipping member 20.

In some embodiments, the disabling member 113 includes an operating portion 1131 and an engaging portion 1132. The elastic protrusion 1133 is disposed on the engaging portion 1132. When the disabling member 113 is installed in place in the first guide groove 1123, the operating portion 1131 is exposed outside the first guide groove 1123. When the disabling member 113 needs to be removed from the fixing base 112, the disabling member can be taken out of the first guide groove 1123 through the operating portion 1131, which is convenient for the user to remove and install the disabling member.

The cooking device 1 according to the embodiments of the present disclosure is described below. The cooking device 1 according to the embodiments of the present disclosure includes a casing 32, a door body 31, and the latching structure 10 for the cooking device 1 according to the above-described embodiments of the present disclosure.

The casing 32 has a limiting portion provided thereon. The door body 31 is engaged with the casing 32 in an openable and closable manner. The door body 31 has a hook provided thereon. The latching structure 10 is disposed on the casing 32. The flipping member 20 is engaged with the hook. The flipping member 20 is configured to drive, in response to being triggered to rotate to the door-opening position, the hook to be detached from the limiting portion, so as to realize the opening or closing of the casing 32 through the door body 31.

In some embodiments, the casing 32 further has a rotating member provided thereon. An end of the flipping member 20 is in contact fit with the rotating member. The door body 31 is disposed on a front side of the casing 32. The hook has a rear surface formed in an arc shape and a front surface extending in the up-down direction. When the casing 32 is closed by the door body 31, the hook is engaged with the limiting portion. In this case, when the user pulls the door body 31, the front surface of the hook is engaged with the limiting portion, and the hook cannot be disengaged with the limiting portion.

When the user presses the flipping member 20 backward, an end of the flipping member 20 in contact with the rotating member rotates upward to drive the rotating member to rotate upward. When the rotating member rotates to a certain position, it drives the hook to rotate upward. That is to say, during the rotation process, the flipping member 20 can drive the hook to rotate upward through the rotating member, so that the hook is disengaged from the limiting portion. In this case, the user can pull the door body 31 to open the casing 32, or when the user presses the flipping member 20, the door body 31 automatically pops forward and opens the casing 32.

When the user needs to close the casing 32, the door body 31 can be operated to move backward. At this moment, the rear surface of the hook is engaged with the limiting portion. When the user presses the door body 31 backward, since the rear surface of the hook is formed in an arc shape, the hook can be rotated upward by a reaction force of the limiting portion acting thereon. After the hook is rotated upward by a certain distance, when the rear surface of the hook is disengaged from the limiting portion, the hook is disengaged with the limiting portion. At this moment, the casing 32 can be closed by the door body 31.

By using the latching structure 10 for the cooking device 1 according to the embodiments of the present disclosure, the cooking device 1 according to the embodiments of the present disclosure has the advantages of locking the door body 31, protecting a child from being scalded due to accidental touch, having a relatively simple structure, and facilitating cost reduction.

In some embodiments of the present disclosure, the flipping member 20 is exposed to a front surface of the casing 32. The pressing surface of the press button 111 is exposed to a side wall of the casing 32, so that the user can operate the flipping member 20 and the press button 111.

In some embodiments, as illustrated in FIG. 1, the flipping member 20 is disposed on a lower left end of a front surface of the casing 32. The press button 111 is disposed on a lower right end of a left surface of the casing 32. On the one hand, it is convenient for the user to operate the flipping member 20 and the press button 111, and on the other hand, the flipping member 20 and the press button 111 are arranged in adjacent areas, so that the restricting member 12 can be driven to be engaged with the flipping member 20 through the press button 111.

In some embodiments of the present disclosure, the casing 32 has a control box 2 provided thereon. The control box 2 is configured to control an operation state of the cooking device 1. The latching structure 10 is located on a rear side of the control box 2. The user can operate the control box 2 to operate on the working state of the cooking device 1. The latching structure 10 is disposed on the rear side of the control box 2, so as to ensure the overall aesthetics of the cooking device 1.

In some embodiments of the present disclosure, the casing 32 has a door-opening button 33 provided thereon. The door-opening button 33 is configured to trigger the flipping member 20. The casing 32 has a press button 111 provided on a side wall thereof adjacent to the door-opening button 33. The press button 111 is configured to push the restricting member 12 to move, which is convenient for the user to operate the door-opening button 33 and the press button 111.

In some embodiments, as illustrated in FIG. 1, the door-opening button 33 is exposed to the front surface of the casing 32. The pressing surface of the press button 111 is exposed to the side wall of the casing 32. The door-opening button 33 is disposed on a lower left end of the front surface of the casing 32. The press button 111 is disposed on a lower right end of the left surface of the casing 32. On the one hand, it is convenient for the user to operate the door-opening button 33 and the press button 111 at the same time. On the other hand, the door-opening button 33 and the press button 111 are arranged in adjacent areas, so that the restricting member 12 can be driven to be engaged with the flipping member 20 through the press button 111.

It can be understood that the latching structure 10 for the cooking device 1 of the present disclosure can not only be applied in the cooking device 1 according to the embodiments of the present disclosure, but also can be applied in other small household appliances, such as refrigerators, washing machines, etc., which need to protect children from open the door due to accidental touch.

The latching structure 10 for the cooking device 1 and the cooking device 1 according to the embodiments of the present disclosure are described below with reference to FIGS. 11-25.

As illustrated in FIGS. 11 to 25, a latching structure 10 for a cooking device 1 is provided according to the embodiments of the present disclosure. The cooking device 1 includes a casing 32 and a door body 31, and the latching structure 10 includes a flipping member 100, a base 200, a press button 111 and a restricting member 12.

The door body 31 is engaged with the casing 32 in an openable and closable manner, so that the casing 32 can be opened or closed through the door body 31. When the user needs to use the cooking device 1, the user can operate the door body 31 to open the casing 32, place food in the casing 32, then close the casing 32 through the door body 31, and cook the food using the cooking device 1. The latching structure 10 includes a flipping member 100, a base 200, a press button 111, and a restricting member 12. The flipping member 100 is rotatably disposed on the casing 32. The flipping member 100 drives, in response to being triggered to rotate into a door-opening position, a door hook 312 of the door body 31 to rotate so as to be detached from a limiting portion 21 on the casing 32. At this moment, the casing 32 can be opened through the door body 31.

Figure 16:
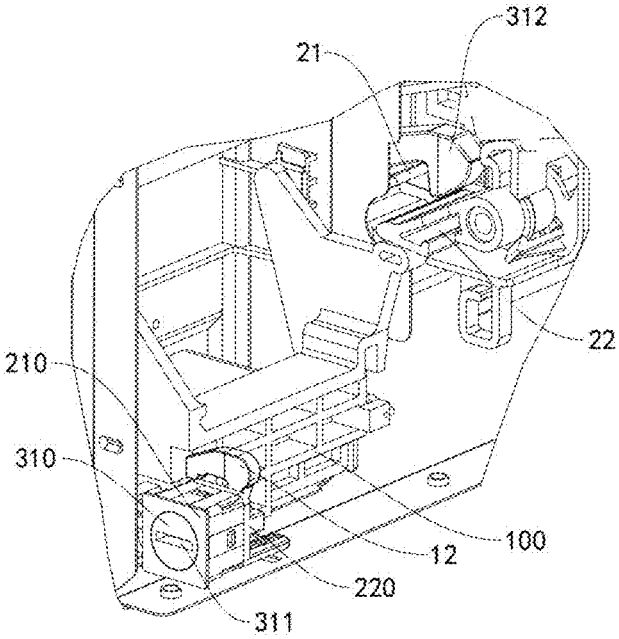
FIG. 16 is an enlarged view of a local portion in FIG. 15.

In some embodiments, the flipping member 100 is directly engaged with the door hook 312, and the flipping member 100 can directly drive the door hook 312 to rotate. In some other embodiments, as illustrated in FIG. 16, the flipping member 100 and the door hook 312 are engaged with each other indirectly. For example, the flipping member 100 is engaged with the door hook 312 through a rotating member 22, the flipping member 100 can drive the rotating member 22 to rotate, and then the rotating member 22 drives the door hook 312 to rotate.

That is to say, the user can change the engagement relation between the door hook 312 and the limiting portion 21 by operating the flipping member 100, so that the door body 31 can move from a position where the casing 32 is closed to a position where the casing 32 is opened. The casing 32 is closed or opened according to the needs of the user. When the casing is closed by the door body 31, the door hook 312 on the door body 31 is engaged with the limiting portion 21 on the casing 32 to ensure that the door body 31 is in a state in which the casing 32 is closed. After the user operates the flipping member 100, the door hook 312 on the door body 31 can be disengaged from the limiting portion 21 on the casing 32, and the door body 31 can move to the position where the casing 32 is opened.

Figure 11:
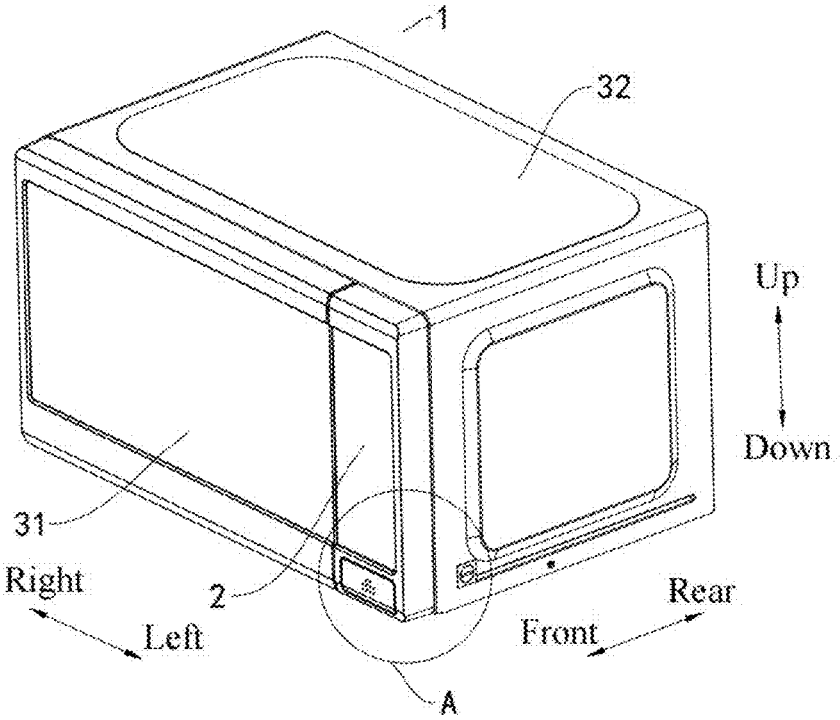
FIG. 11 is a schematic structural diagram of a cooking device according to embodiments of the present disclosure.
Figure 12:
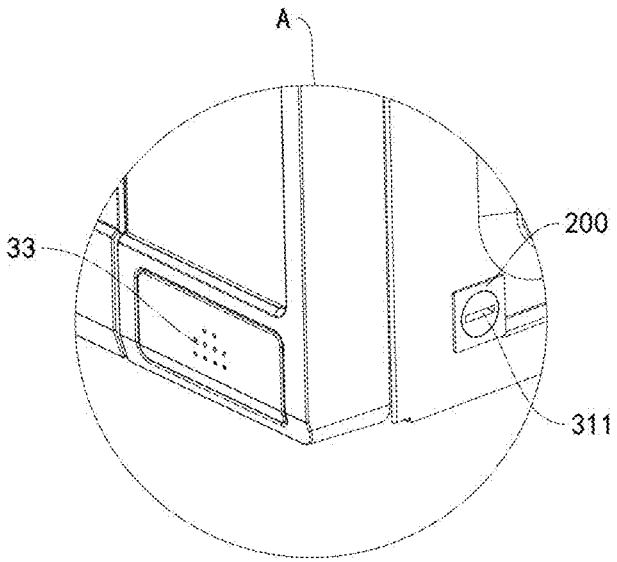
FIG. 12 is an enlarged view of position A in FIG. 11.

Referring to FIGS. 11 to 12, the base 200 is disposed on the casing 32, and the press button 111 is movably disposed on the base 200. The user can operate the press button 111 to move the press button 111. The base 200 can limit a position of the press button 111, so that the press button 111 can be disposed on the casing 32. Since the flipping member 100 is also disposed on the casing 32, it is convenient for the user to operate the press button 111 and the flipping member 100 at the same time.

Figure 20:
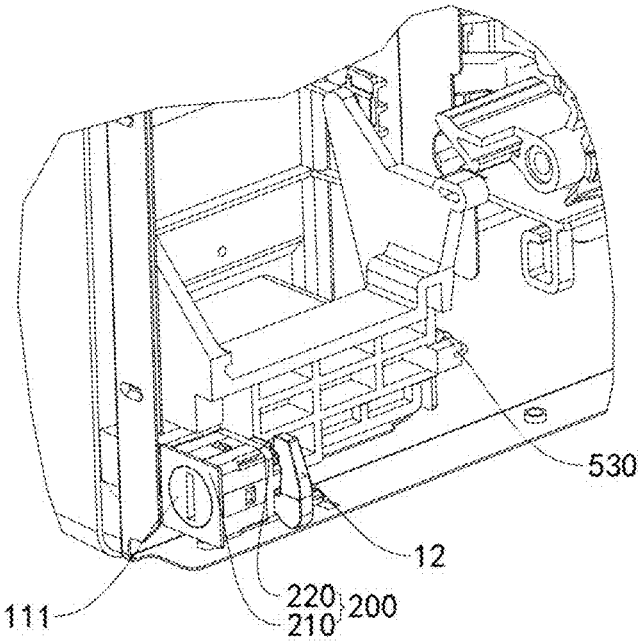
FIG. 20 is an enlarged view of a local portion in FIG. 19.

In addition, in some embodiments, as illustrated in FIG. 20, the press button 111 is disposed in the base 200, the press button 111 is engaged with the base 200, and the base 200 can limit a moving direction of the press button 111, so as to avoid a case where the press button 200 falls off from the base 200 when the user operates the press button 111.

Figure 15:
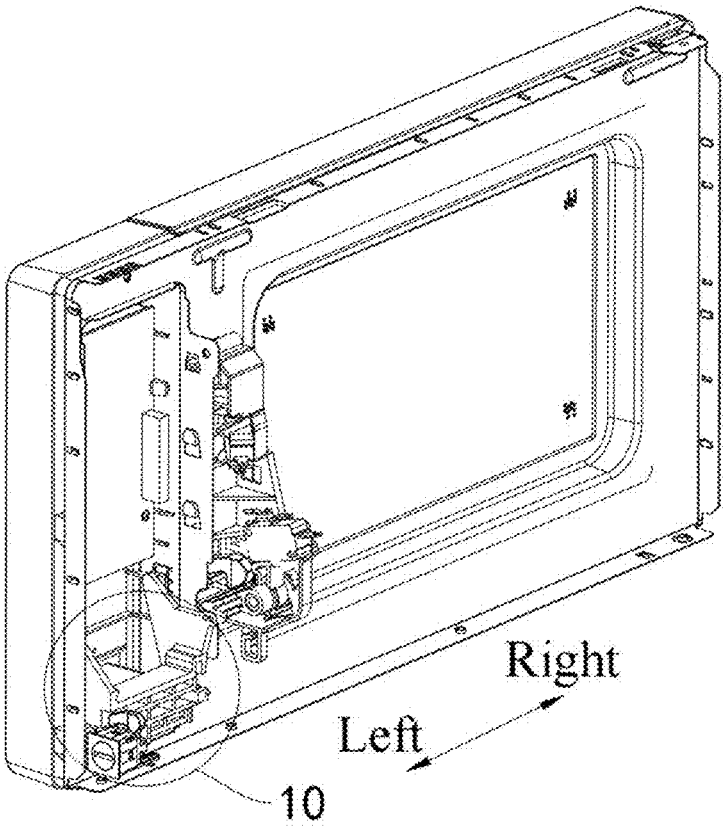
FIG. 15 is a schematic diagram of a partial structure of a cooking device in another direction when a restricting member is in a locking position according to embodiments of the present disclosure.
Figure 21:
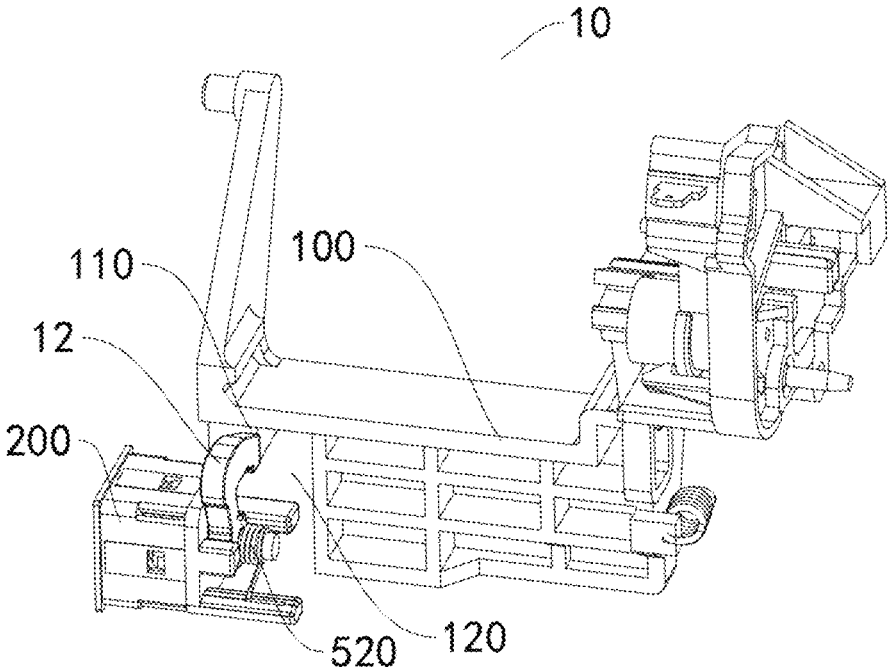
FIG. 21 is a schematic structural diagram of a latching structure of a cooking device according to embodiments of the present disclosure.

Referring to FIGS. 15 to 16 and 21, the restricting member 12 is engaged with the press button 111 to move synchronously with the press button 111. The press button 111, when moving, can drive the restricting member 12 to move between a locking position and an unlocking position. When the restricting member 12 is in the locking position, the restricting member 12 is located on a rotation path of the flipping member 100 to block the flipping member 100 from rotating towards the door-opening position. In this case, when the user operates the flipping member 100, since the restricting member 12 blocks the rotation of the flipping member 100, the door hook 312 of the door body 31 is still engaged with the limiting portion 21 on the casing 32, and the door body 31 cannot move to the position where the casing 32 is opened.

In some embodiments, when the restricting member 12 is in the locking position, an end of the restricting member 12 always abuts on the flipping member 100, the restricting member 12 can limit the position of the flipping member 100, the user cannot operate the flipping member 100 to rotate in the casing 32, and the door hook 312 of the door body 31 and the limiting portion 21 on the casing 32 are in an engaged state. In some other embodiments, when the restricting member 12 is in the locking position, there is a gap between the restricting member 12 and the flipping member 100, and when the user operates the flipping member 100, and the flipping member 100 rotates by a certain distance, an end of the restricting member 12 abuts on the flipping member 100. Although the flipping member 100 rotates by a certain distance, it is not enough for the flipping member 100 to rotate into the door-opening position, and the door hook 312 of the door body 31 and the limiting portion 21 on the casing 32 are still in the engaged state.

Figure 17:
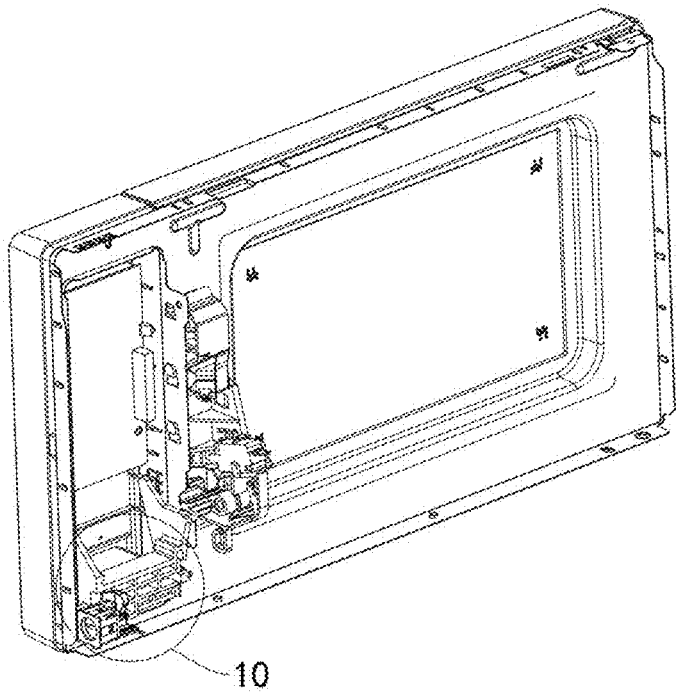
FIG. 17 is a schematic diagram of a partial structure of a cooking device when a restricting member is in an unlocking position according to an embodiment of the present disclosure.
Figure 18:
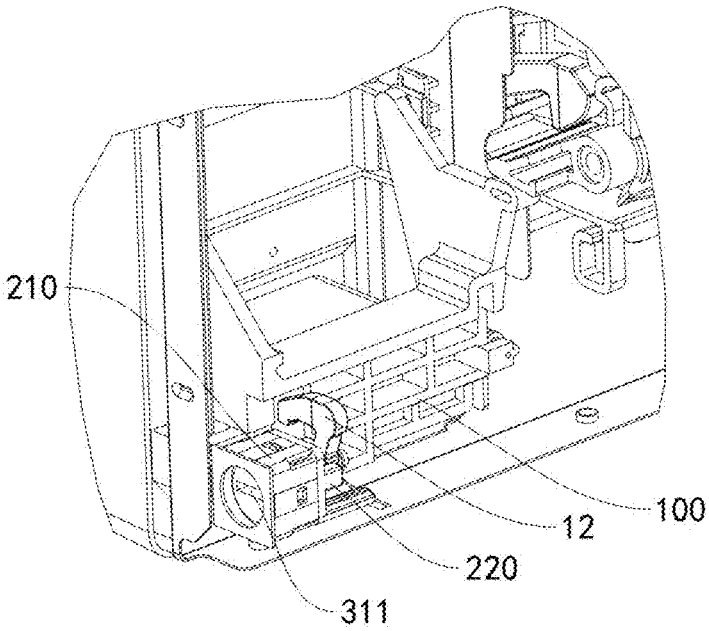
FIG. 18 is an enlarged view of a local portion in FIG. 17.
Figure 19:
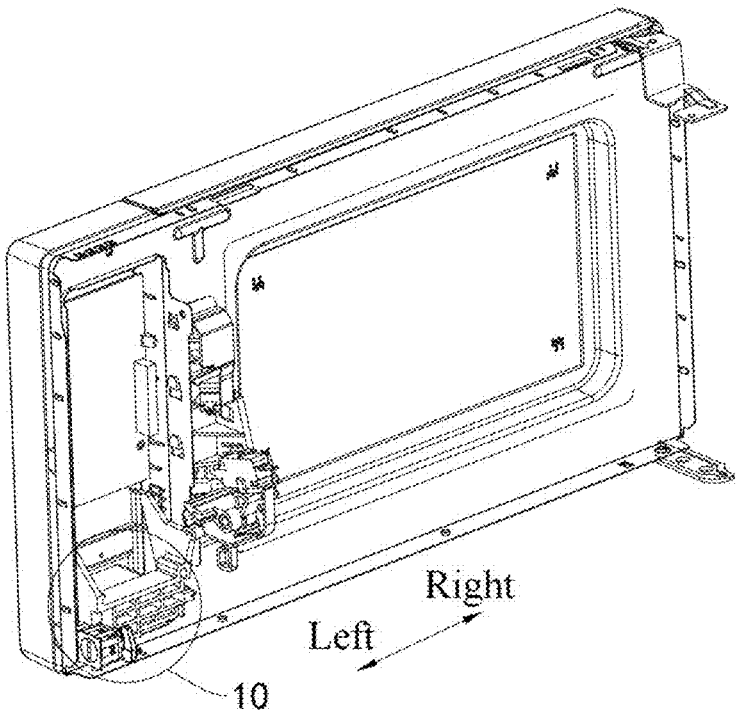
FIG. 19 is a schematic diagram of a partial structure of a cooking device when a restricting member is in a disabled state according to an embodiment of the present disclosure.

In the unlocking position, as illustrated in FIGS. 17 to 18, the restricting member 12 avoids the flipping member 100. When the user operates the flipping member 100, the flipping member 100 can move to the door-opening state, thereby driving the door hook 312 of the door body 31 to disengage from the limiting portion 21 on the casing 32, and the door body 31 can move to the position where the casing 32 is opened.

The latching structure 10 set in this way can realize the double locking of the door body 31. When the casing 32 needs to be opened through the door body 31, the user needs to move the restricting member 12 to the unlocking position, and move the flipping member 100 to the door-opening state. The casing 32 can be opened only through step-by-step operations, so as to protect a child from being scalded when the casing 32 is opened due to accidental touch.

In addition, the latching structure 10 can lock the flipping member 100 by the provision of the base 200, the press button 111, and the restricting member 12, and the provision of the flipping member 100 realizes the locking of the door body 31 and the casing 32. The latching structure 10 has a relatively simple structure, has a small modification to the cooking device 1, and has a small number of parts, which facilitates reducing the production cost of the latching structure 10.

Therefore, the latching structure 10 for the cooking device 1 according to the embodiments of the present disclosure has the advantages of locking the door body 31, protecting children from being scalded due to accidental touch, having a relatively simple structure, and facilitating cost reduction.

The latching structure 10 for the cooking device 1 according to specific embodiments of the present disclosure is described below with reference to the accompanying drawings.

As illustrated in FIGS. 11 to 25, the cooking device 1 includes a casing 32 and a door body 31, and the latching structure 10 includes a flipping member 100, a base 200, a press button 111 and a restricting member 12.

In some embodiments of the present disclosure, the press button 111 is rotatably disposed on the base 200, and the press button 111 is configured to rotate to drive the restricting member 12 to switch between an enabled state and a disabled state. When the restricting member 12 is in the enabled state, the press button 200 moves to drive the restricting member 12 to move between the locking position and the unlocking position. When the restricting member 12 is in the disabled state, with reference to FIGS. 19 to 20, the restricting member 12 avoids the flipping member 100, and the user can rotate the flipping member 100 into the door-opening state without operating the restricting member 12, so as to meet the different needs of different users.

When the user does not need to restrict the rotation of the flipping member 100, the user can rotate the press button 111 to drive the restricting member 12 to switch to the disabled state. In this case, the restricting member 12 avoids the flipping member 100, and the user does not need to perform any further operations on the restricting member 12 and instead can directly operate the flipping member 100, so that the flipping member 100 rotates to the door-opening position to open the casing 32.

When the user needs to restrict the rotation of the flipping member 100, the user can rotate the press button 111 to drive the restricting member 12 to switch to the enabled state. In this case, the restricting member 12 blocks the flipping member 100 from rotating to the door-opening position. When the user needs to open the casing 32, the user needs to move the restricting member 12 to the unlocking position first, and then operate the flipping member 100 to rotate to the door-opening position to open the casing 32.

Figure 23:
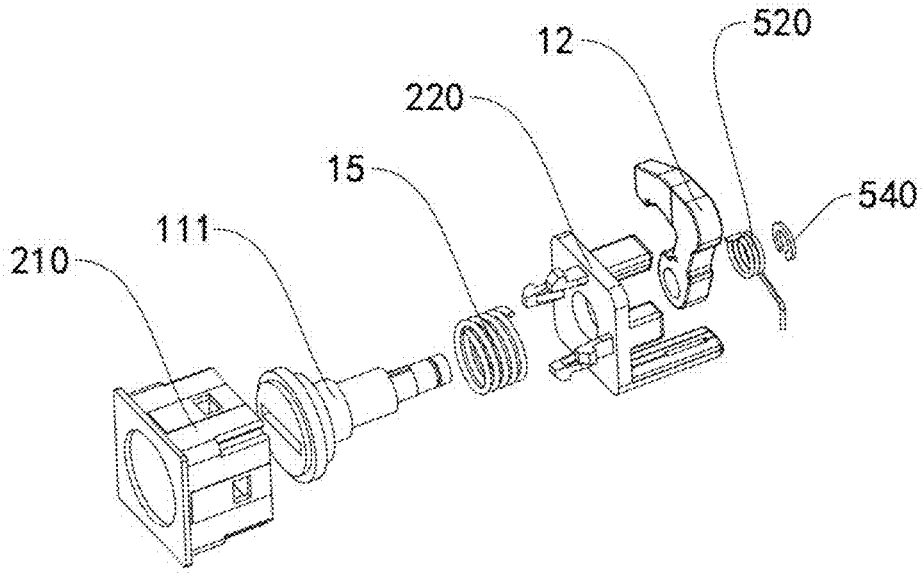
FIG. 23 is an exploded view of FIG. 22.

In some embodiments of the present disclosure, with reference to FIG. 23, the latching structure 10 for the cooking device 1 further includes a second restoring member 15. The second restoring member 15 is connected to the press button 111 and the base 200 respectively. The second restoring member 15 provides a restoring force to the press button 111 to allow the press button 111 to move into an initial position, and to drive the restricting member 12 to move to the locking position through the press button 111. The restricting member 12 can always block the flipping member 100 from moving towards the door-opening position. Each time, the press button 111 needs to be operated to move the restricting member 12 into the unlocking position, so that the door body 31 is opened through step-by-step operations each time, and the door body 31 is prevented from being opened due to accidental touch.

In some embodiments, as illustrated in FIGS. 15 to 18, when the restricting member 12 is in the enabled state and the user operates the press button 111 to move in the base 200, the press button 111 drives the restricting member 12 to move between the locking position and the unlocking position. When the press button 111 drives the restricting member 12 to move into the unlocking position, the user can operate the flipping member 100 to rotate the flipping member 100 into the door-opening position, so that the door hook 312 of the door body 31 is disengaged from the limiting portion 21 on the casing 32, and the casing 32 can be opened.

When the user releases the press button 111, the second restoring member 15 can provide a restoring force to the press button 111 to allow the press button 111 to move into the initial position, and then the restricting member 12 is driven by the press button 111 to move to the locking position. In this way, it is ensured that each time, in order to open the door body 31, it is necessary to operate the press button 111 and the flipping member 100, to prevent the door body 31 from being opened due to accidental touch.

Figure 13:
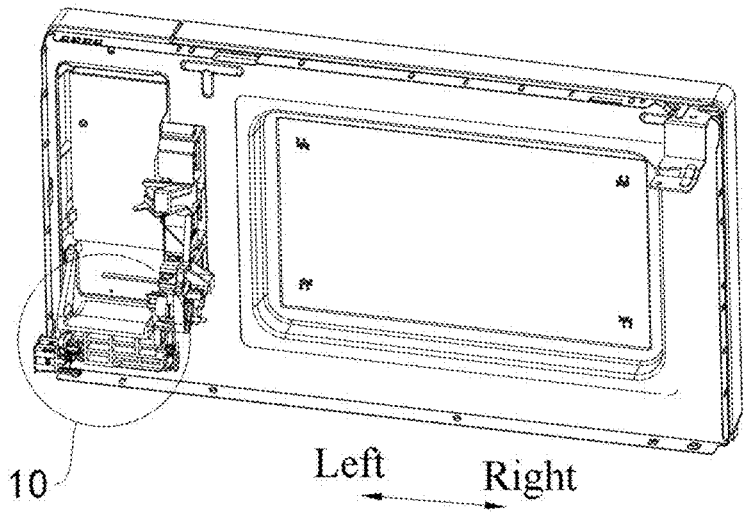
FIG. 13 is a schematic diagram of a partial structure of a cooking device in a direction when a restricting member is in a locking position according to embodiments of the present disclosure.
Figure 14:
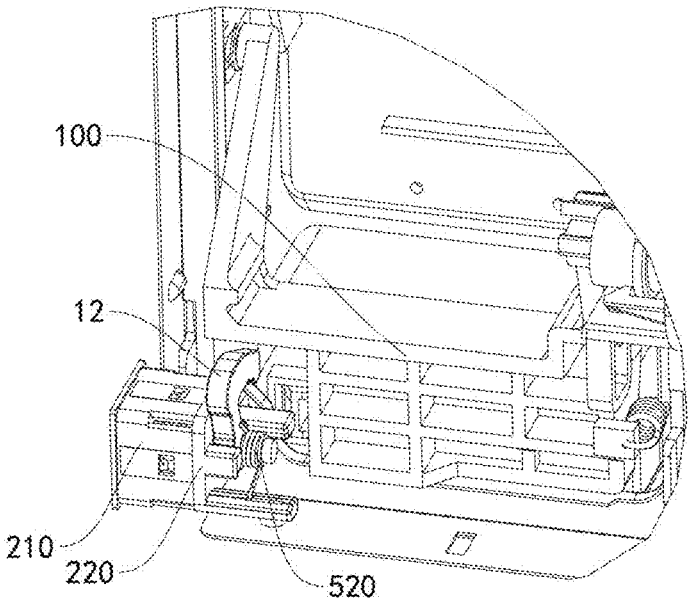
FIG. 14 is an enlarged view of a local portion in FIG. 13.

In some examples, the second restoring member 15 is a compression spring. The user can press the press button 111 to move the press button 111 to the right. At this moment, the second restoring member 15 is elastically deformed and compressed, so that the second restoring member 15 always has a leftward thrust on the press button 111 (the left-right direction is as shown in FIG. 13). In this way, after the user releases the press button 111, the second restoring member 15 can always have an enough force to drive the press button 111 to be restored to the initial position, and then drive the restricting member 12 to move to the locking position through the press button 111.

Figure 22:
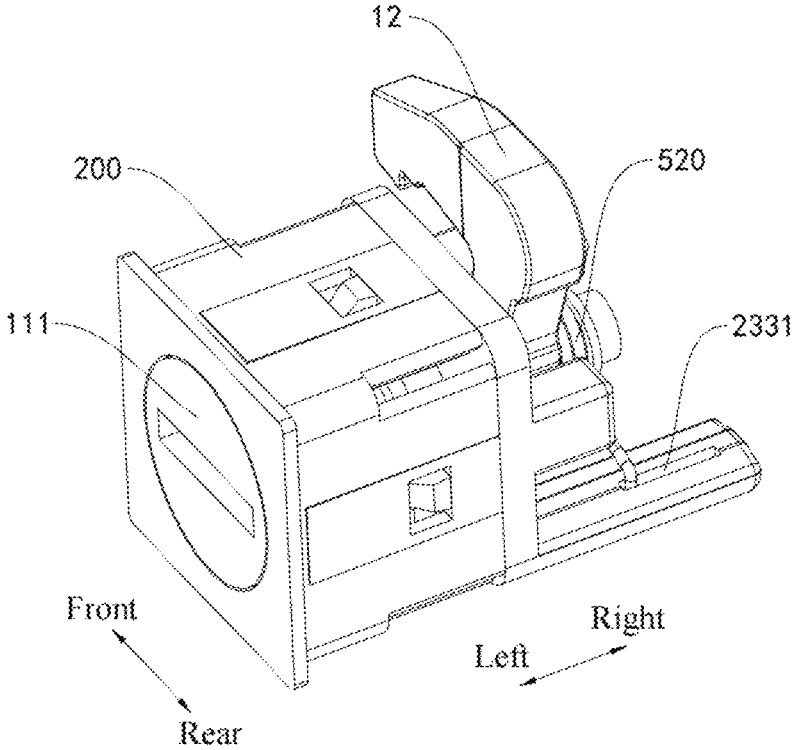
FIG. 22 is a schematic diagram of a partial structure of a latching structure of a cooking device according to embodiments of the present disclosure.

In some embodiments of the present disclosure, with reference to FIGS. 22 to 23, the latching structure 10 for the cooking device 1 further includes a first restoring member 520. The first restoring member 520 is engaged with the restricting member 12 and the base 200 respectively. The first restoring member 520 provides the restricting member 12 with a torsion force for allowing the restricting member 12 to rotate towards the enabled state. On the one hand, it can ensure that when the restricting member 12 is not operated, the restricting member 12 will not automatically rotate to the disabled state, and on the other hand, it can ensure that when the restricting member 12 is in the locking position, the restricting member 12 has a sufficient force on a side thereof facing towards the flipping member 100 to block the flipping member 100 from rotating towards the door-opening position.

In some specific embodiments, the first restoring member 520 is a torsion spring, so as to provide the restricting member 12 with a torsion force for allowing the restricting member 12 to rotate towards the enabled state by using the torsion spring.

In some embodiments, with reference to FIG. 23, the latching structure 10 further includes a circlip 540. The circlip 540 and the first restoring member 520 are both sleeved on the press button 111. The circlip 540 fits with the first restoring member 520. The circlip 540 can limit the position of the first restoring member 520 to prevent the first restoring member 520 from disengaging from the restricting member 12 and the base 200.

Figure 24:
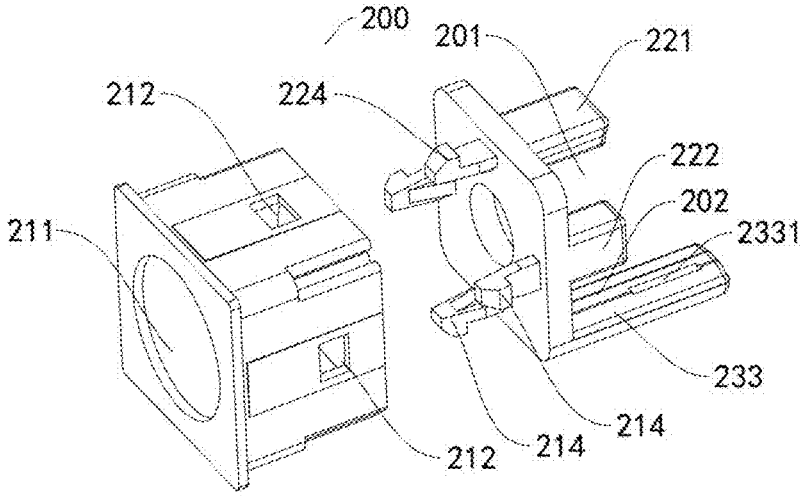
FIG. 24 is a structural exploded view of a base according to embodiments of the present disclosure.
Figure 25:
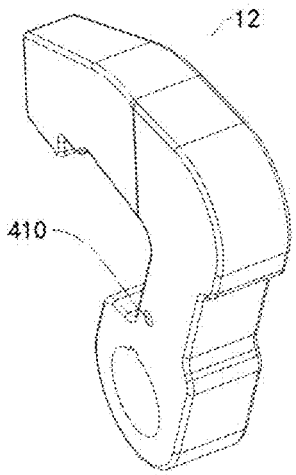
FIG. 25 is a schematic structural diagram of a restricting member according to embodiments of the present disclosure.

In some embodiments, with reference to FIGS. 24 to 25, the restricting member 12 has a mounting hole 410 defined therein. The base 200 has a mounting groove 2331 defined thereon. A first end of the first restoring member 520 extends into the mounting hole 410, and a second end of the first restoring member 520 is engaged with the mounting groove 2331. When the user operates the press button 111 to move, the press button 111 drives the restricting member 12 to move, and the first restoring member 520 moves along with the restricting member 12, the second end of the first restoring member 520 is movable in the mounting groove 2331, to ensure that the first restoring member 520 can smoothly move with the restricting member 12, and the first restoring member 520 always provides the restricting member 12 with a torque for allowing the restricting member 12 to rotate to the locking position.

In some optional embodiments, a length of the mounting groove 2331 is adapted to a movable distance of the press button 111, to ensure that during the movement of the press button 111, the second end of the first restoring member 520 can move smoothly in the mounting groove 2331, thereby preventing the first restoring member 520 from being stuck in the mounting groove 2331 to affect the movement of the press button 111 and the restricting member 12.

In some embodiments of the present disclosure, with reference to FIGS. 23 to 24, the base 200 has a first limiting portion 201 and a second limiting portion 202 provided thereon. The first limiting portion 201 is engaged with or disengaged from the restricting member 12. The second limiting portion 202 is engaged with or disengaged from the restricting member 12. When the restricting member 12 is in the enabled state, the first limiting portion 201 is engaged with the restricting member 12 to guide a moving direction of the restricting member 12 to ensure that the restricting member 12 can move smoothly between the locking position and the unlocking position. When the restricting member 12 is in the disabled state, the second limiting portion 202 is engaged with the restricting member 12 to position the restricting member 12 so that the restricting member 12 can be maintained in the disabled state.

In some embodiments, the restricting member 12 is movable between the first limiting portion 201 and the second limiting portion 202, and the restricting member 12 can be switched between the enabled state and the disabled state. When the restricting member 12 is in the enabled state, the restricting member 12 is engaged with the first limiting portion 201. In this case, the user can operate the press button 111 to move and then rotate in a positive direction, so as to drive the restricting member 12 to move in a direction away from the base 200 and then rotate in a positive direction, so that the restricting member 12 is disengaged from the first limiting portion 201. When the user continues to operate the press button 111 to move into the initial position, the restricting member 12 can be driven to move to the second limiting portion 202 and to be engaged with the second limiting portion 202, so that the restricting member 12 is in the disabled state.

When the user needs to move the restricting member 12 from the disabled state to the enabled state, in some embodiments, the user can operate the press button 111 to move and then rotate in an opposite direction, so as to drive the restricting member 12 to move in a direction away from the base 200 and then rotate in an opposite direction, so that the restricting member 12 is disengaged from the second limiting portion 202. After the user releases the press button 111, the restricting member 12 is driven by the second restoring member 15 to move to the first limiting portion 201 and to be engaged with the first limiting portion 201, so that the restricting member 12 is in the enabled state.

In some other embodiments, the user can operate the press button 111 to move and then release the press button 111. In this case, the first restoring member 520 can drive the restricting member 12 to rotate in an opposite direction, so that the restricting member 12 is disengaged from the second limiting portion 202. Under driving by the second restoring member 15, the restricting member 12 moves to the first limiting portion 201 and is engaged with the first limiting portion 201, so that the restricting member 12 is in the enabled state.

In some optional embodiments of the present disclosure, the base 200 has a first limiting post 221, a second limiting post 222, and a third limiting post 223 provided thereon. The first limiting post 221, the second limiting post 222, and the third limiting post 223 are arranged at intervals in a rotation direction of the press button 111. The first limiting portion 201 is defined by the first limiting post 221 and the second limiting post 222, and the second limiting portion 202 is defined by the second limiting post 222 and the third limiting post 223.

In some embodiments, as illustrated in FIG. 24, the first limiting post 221 and the second limiting post 222 extend in the left-right direction (the left-right direction is as shown in FIG. 22), and the first limiting post 221 and the second limiting post 222 define the first limiting portion 201 extending in the left-right direction. When the restricting member 12 is engaged with the first limiting portion 201, and the user operates the press button 111 to move the press button 111 in the left-right direction, the press button 111 can drive the restricting member 12 to move in the left-right direction in the first limiting portion 201, and the first limiting portion 201 can limit the moving direction of the restricting member 12, so as to prevent the restricting member 12 from rotating when the restricting member 12 moves in the first limiting portion 201.

The third limiting post 223 extends in the left-right direction, and the second limiting post 222 and the third limiting post 223 define the second limiting portion 202 extending in the left-right direction. When the restricting member 12 is engaged with the second limiting portion 202 and the user operates the press button 111 to move the press button 111 in the left-right direction, the press button 111 can drive the restricting member 12 to move in the left-right direction, so that the restricting member 12 is movable in the left-right direction in the second limiting portion 202, and the second limiting portion 202 can limit the moving direction of the restricting member 12 to prevent the restricting member 12 from rotating when the restricting member 12 moves in the second limiting portion 202.

In some examples, as illustrated in FIGS. 22 and 24, both the first limiting post 221 and the second limiting post 222 are disposed on a right end surface of the base 200, the first limiting post 221 is disposed on a front side of the second limiting post 222 (in the front-rear direction as shown in FIG. 22), and the third limiting post 223 is disposed on a lower end of the second limiting post 222. The first limiting post 221 and the third limiting post 223 each has a length greater than a length of the second limiting post 222. It should be understood here that the lengths of the first limiting portion 201 and the second limiting portion 202 in the left-right direction depend on the length of the second limiting post 222 in the left-right direction.

In some embodiments, when the user needs to move the restricting member 12 from the first limiting portion 201 to the second limiting portion 202, the restricting member 12 is initially in the locking position, and the restricting member 12 is in the first limiting portion 201, the user operates the press button 111 to move by a certain distance to the right, to drive the restricting member 12 to move by a certain distance to the right. When the restricting member 12 moves to the right and exceeds the second limiting post 222, the restricting member 12 is disengaged from the first limiting portion 201.

The length of the first limiting post 221 in the left-right direction is greater than the length of the second limiting post 222 in the left-right direction. On the one hand, it is ensured that after the restricting member 12 is disengaged from the first limiting portion 201, the restricting member 12 can still move in the left-right direction along the first limiting post 221. On the other hand, since the first restoring member 520 always drives the restricting member 12 to rotate towards the enabled state, the first limiting post 221 can limit the rotatable direction of the restricting member 12.

After the restricting member 12 is disengaged from the first limiting portion 201, the user can rotate the press button 111 backward to drive the restricting member 12 to rotate backward. In this case, the user continues to operate the press button 111 to move to the left, so as to drive the restricting member 12 to move to the second limiting portion 202 in the left-right direction.

The length of the third limiting post 223 in the left-right direction is greater than each of the lengths of the second limiting post 222 and the first limiting post 221 in the left-right direction. On the one hand, it can limit a rotatable range of the restricting member 12 and prevent the restricting member 12 from rotating backward by an excessively large angle to disengage from the base 200. On the other hand, it can guide the moving direction of the restricting member 12, to ensure that the restricting member 12 moves smoothly in the left-right direction along the third limiting post 223 to the second limiting portion 202.

In some embodiments, the third limiting post 223 has a mounting groove 2331 defined thereon. A first end of the first restoring member 520 is engaged with the restricting portion, a second end of the first restoring member 520 is engaged with the mounting groove 2331, and the first restoring member 520 always drives the restricting member 12 to rotate towards the enabled state.

When the user needs to move the restricting member 12 from the second limiting portion 202 to the first limiting portion 201, the restricting member 12 is initially in the disabled stat, and the restricting member 12 is in the second limiting portion 202, the user operates the press button 111 to move to the right by a certain distance so that the restricting member 12 moves to the right and exceeds the second limiting post 222, and the restricting member 12 is disengaged from the second limiting portion 202. After the restricting member 12 is disengaged from the second limiting portion 202, the first restoring member 520 drives the restricting member 12 to rotate forward, so that the restricting member 12 rotates to a position where the restricting member 12 is engaged with the first limiting post 221. After the user releases the press button 111, the press button 111 is driven by the second restoring member 15 to move to the initial position, so as to drive the restricting member 12 to move into the first limiting portion 201.

In some optional embodiments of the present disclosure, with reference to FIGS. 23 to 24, the base 200 includes a cover body 210 and a fixing base 220. The cover body 210 has a pressing hole 211. The fixing base 220 is fixed on the cover body 210. The press button 111 is disposed in the cover body 210 and is directly opposite to the pressing hole 211. On the one hand, the pressing hole 211 can limit the movable direction of the press button 111, and on the other hand, it facilitates the user to operate the press button 111 through the pressing hole 211.

In addition, the press button 111 partially extends through the fixing base 220 to be engaged with the restricting member 12, so that when the user operates the press button 111, the press button 111 drives the restricting member 12 to move or rotate. The first limiting portion 201 and the second limiting portion 202 are disposed on a side wall of the fixing base 220 facing away from the cover body 210, so that the positions of the first limiting portion 201 and the second limiting portion 202 correspond to the position of the restricting member 12. It is ensured that the first limiting portion 201 and the second limiting portion 202 can limit the movement or rotation of the restricting member 12.

In some embodiments, the restricting member 12 is sleeved on the press button 111 and is in key fit with the press button 111, to ensure that the press button 111, when moving or rotating, can drive the restricting member 12 to move or rotate.

In some specific embodiments of the present disclosure, the cover body 210 and the fixing base 220 are in snap fit with each other. As illustrated in FIG. 24, the cover body 210 has a plurality of snap holes 212, and the plurality of snap holes 212 is arranged circumferentially on side walls of the cover body 210. Snap portions 224 are disposed at a corresponding position on the fixing base 220. Each snap portion 224 can be engaged with the snap hole 212 to fix the fixing base 220 on the cover body 210.

In some embodiments of the present disclosure, with reference to FIG. 20, the latching structure 10 for the cooking device 1 further includes a third restoring member 530. The third restoring member 530 is connected to the flipping member 100 and the casing 32. The third restoring member 530 provides the flipping member 100 with a restoring force for allowing the flipping member 100 to rotate towards a non-triggered position. In this way, it is ensured that after the user releases the flipping member 100, the flipping member 100 can automatically restore to the non-triggered position, which is convenient for the user to operate the flipping member 100 next time.

In some embodiments, the third restoring member 530 is a tension spring. The user can press the flipping member 100 to rotate the flipping member 100 backwards, so that the third restoring member 530 is elastically deformed and elongated, and the third restoring member 530 always has a forward pulling force on the flipping member 100. In this way, it is ensured that after the user releases the flipping member 100, the third restoring member 530 can always have a sufficient force to drive the flipping member 100 to be restored to the initial position.

In some optional embodiments of the present disclosure, the latching structure 10 is configured in a manner that during the rotation of the flipping member 100 toward the non-triggered position, the flipping member 100 blocks the movement of the restricting member 12 towards the locking position, so as to ensure that the flipping member 100 can rotate preferentially to the non-triggered position, and prevent the restricting member 12 from blocking the rotation of the flipping member 100 when the restricting member 12 moves from the unlocking position to the rotating position.

In some embodiments, during rotation of the flipping member 100 to the non-triggered position, the restricting member 12 is between the unlocking position and the locking position. In this case, the restricting member 12 will not block the rotation of the flipping member 100, so that the flipping member 100 can rotate smoothly to the non-triggered position. After the flipping member 100 rotates to the non-triggered position, the restricting member 12 can move to the locking position to restrict the rotation of the flipping member 100 again.

In some other optional embodiments of the present disclosure, the latching structure 10 is configured in a manner that the restricting member 12 avoids the rotation of the flipping member 100, so that the flipping member 100 can smoothly rotate to the non-triggered position.

In some embodiments, during the rotation of the flipping member 100 to the non-triggered position, the restricting member 12 is in the unlocking position to avoid the rotation of the flipping member 100, and the restricting member 12 will not block the rotation of the flipping member 100, so that the flipping member 100 can smoothly rotate to the non-triggered position. After the flipping member 100 rotates to the non-triggered position, the restricting member 12 moves to the locking position, to restrict the rotation of the flipping member 100 again.

In some optional embodiments of the present disclosure, the flipping member 100 has an abutting-stopping portion 110 and an avoidance space 120 provided thereon. The abutting-stopping portion 110 and the avoidance space 120 are disposed in sequence in the moving direction of the press button 111. When the restricting member 12 is in the locking position and the flipping member 100 is triggered, the restricting member 12 abuts on the abutting-stopping portion 110 and is stopped by the abutting-stopping portion, so as to block the flipping member 100 from rotating towards the door-opening position through the engagement of the limiting portion 21 and the abutting-stopping portion 110.

When the restricting member 12 is in the unlocking position, the restricting member 12 directly faces the avoidance space 120, so that the restricting member 12 can avoid the rotation of the flipping member 100, and the flipping member 100 can smoothly rotate to the door-opening position.

In some embodiments, the restricting member 12 is movable in the left-right direction, and the abutting-stopping portion 110 and the avoidance space 120 are arranged in sequence from left to right. When the restricting member 12 is in the enabled state, the restricting member 12 is located in the locking position initially, and the restricting member 12 corresponds to the position of the abutting-stopping portion 110, so that when the flipping member 100 is triggered, the restricting member 12 is engaged with the abutting-stopping portion 110, and the flipping member 100 is blocked from rotating towards the door-opening position by using the abutting-stopping portion 110.

The user can move the restricting member 12 to the right by operating the press button 111, so as to move the restricting member 12 to the unlocking position. In this case, the position of the restricting member 12 corresponds to the position of the avoidance space 120, to avoid the rotation of the flipping member 100 and allow the flipping member 100 to smoothly rotate to the door-opening position. After the user releases the press button 111, the restricting member 12 is driven by the second restoring member 15 to move to the right to the locking position, so that the restricting member 12 corresponds to the position of the abutting-stopping portion 110 again.

In some specific embodiments of the present disclosure, the latching structure 10 further includes a second restoring member 15 and a third restoring member 530. The second restoring member 15 is connected to the press button 111 and the base 200 respectively, and the second restoring member 15 provides a restoring force to the press button 111 to allow the restricting member 12 to move into the locking position, which is convenient for the user to re-operate the press button 111 in subsequent operations and drive the restricting member 12 to move to the avoidance position, realizing the step-by-step operations of opening the casing 32.

The third restoring member 530 is connected to the flipping member 100 and the casing 32. The third restoring member 530 provides the flipping member 100 with a restoring force for allowing the flipping member 100 to rotate towards the non-triggered position. On the one hand, it facilitates the flipping member 100 to automatically restore to the non-triggered position, so as to be convenient for the user to operate the flipping member 100 next time. On the other hand, it can prevent the flipping member 100 from affecting the movement of the restricting member 12, and ensure that the restricting member 12 can smoothly move to the locking position.

When the flipping member 100 rotates towards the non-triggered position, the second restoring member 15 pulls the press button 111 in such a manner that the restricting member 12 is brought into contact with a side wall of the abutting-stopping portion 110 facing towards the avoidance space 120 until the restricting member 12 directly faces the abutting-stopping portion 110. In this way, it is ensured that after the user releases the press button 111 and the flipping member 100, the flipping member 100 can smoothly rotate to the door-opening position, and the restriction member 12 is prevent from being stuck on the side wall of the abutting-stopping portion 110 facing towards the avoidance space 120 to affect the rotation of the flipping member 100.

In some embodiments, the flipping member 100 can rotate in the front-rear direction, the press button 111 can drive the restricting member 12 to move in the left-right direction, and an end of the abutting-stopping portion 110 facing towards the avoidance space is formed into a rounded corner. In this way, it is ensured that when the restricting member 12 moves in the left-right direction, the flipping member 100 rotates in the front-rear direction, and the restricting member 12 is in contact with the side wall of the abutting-stopping portion 110 facing towards the avoidance space 120, the restricting member 12 will not jam the abutting-stopping portion 110, so as to ensure the smooth movement of the restricting member 12 and the smooth rotation of the abutting-stopping portion 110.

In some optional embodiments of the present disclosure, the restoring force provided by the third restoring member 530 to the flipping member 100 is greater than the restoring force provided by the second restoring member 15 to the press button 111, so that the flipping member 100 can be preferentially restored to the non-triggered position, and then the press button 111 is restored to the initial position and drives the restricting member 12 to be restored to the locking position. In this way, the restricting member 12 can avoid the restoration of the flipping member 100, a case where the restricting member 12 blocks the rotation of the flipping member 100 towards the non-triggered position during the movement of the restricting member 12 from the unlocking position to the locking position is avoided, and the restricting member 12 and the flipping member 100 are prevented from jamming each other during the movement.

That is to say, when the casing 32 needs to be opened, the user can first move the restricting member 12 to the unlocking position, and then operate the flipping member 100 to move to the door-opening state. When the user releases the flipping member 100 and the restricting member 12 at the same time, the flipping member 100 is preferentially restored to the non-triggered position under the driving of the third restoring member 530, so that the restricting member 12 can be smoothly restored to the locking position after the flipping member 100 is restored to the non-triggered position, and mutual obstruction of the restricting member 12 and the flipping member 100 are prevented during the restoring process.

In some embodiments of the present disclosure, the press button 111 has a pressing surface 310 with an insertion hole 311. The latching structure 10 further includes a key which is in insertion fit with the insertion hole 311. When the key is engaged with the insertion hole 311, rotation of the key drives the press button 111 to rotate, to drive the restricting member 12 to rotate.

In some embodiments, when there is a need to switch the restricting member 300 from the enabled state to the disabled state, the user can drive the press button 111 to move to the right while inserting the key and then rotate the key in a positive direction to drive the press button 111 to rotate in a positive direction, so that the press button 111 drives the restricting member 12 to move to the right by a certain distance and then rotate in the positive direction. Then, the press button 111 is operated to move to the left so as to drive the restricting member 12 to move to the left to be engaged with the second limiting portion 202, so that the restricting member 12 is switched to the disabled state.

When there is a need to switch the restricting member 12 from the disabled state to the enabled state, in some embodiments, the user can drive the press button 111 to move to the right while inserting the key and then rotate the key in an opposite direction to drive the press button 111 to rotate in a positive direction, so that the press button 111 drives the restricting member 12 to move to the right by a certain distance and then rotate in the opposite direction. Then, the key is pulled out, the press button 111 moves to the right to the initial position under the driving of the second recovering member 15 so as to drive the restricting member 12 to move to the left to be engaged with the first limiting portion 201, so that the restricting member 12 is switched from the disabled state to the enabled state.

In some other embodiments, the user can drive the press button 111 to move to the right while inserting the key, so as to drive the restricting member 12 to move to the right by a certain distance. In this case, the user can release the press button 111, the restricting member 12 can be driven to rotate in the opposite direction under the action of the first restoring member 520, and then, under the driving of the second restoring member 15, the press button 111 moves to the right to the initial position, so as to drive the restricting member 12 to move to the left to be engaged with the first limiting portion 201. In this way, the restricting member 12 is switched from the disabled state to the enabled state.

The cooking device 1 according to the embodiments of the present disclosure is described below. The cooking device 1 according to the embodiments of the present disclosure includes a casing 32, a door body 31, and the latching structure 10 for the cooking device 1 according to the above-mentioned embodiments of the present disclosure.

The casing 32 has a limiting portion 21 provided thereon. The door body 31 is connected to the casing 32 in an openable and closable manner. The door body 31 has a door hook 312 provided thereon. The door hook 32 is engaged with or disengaged from the limiting portion 21 to close or open the casing 32 through the door body 31.

The latching structure 10 is the latching structure 10 of the above-mentioned embodiments of the disclosure. The latching structure 10 is disposed on the casing 32. The flipping member 100 is engaged with the door hook 312. The flipping member 100 can drive the door hook 312 to rotate, so as to realize the engagement or disengagement between the door hook 312 and the limiting portion 21.

In some embodiments, as illustrated in FIG. 16, the casing 32 further has a rotating member 22 provided thereon. An end of the flipping member 100 is in contact fit with the rotating member 22. The door body 31 is disposed on a front side of the casing 32. The door hook 312 has a rear surface formed in an arc shape and a front surface extending in the up-down direction. When the casing 32 is closed by the door body 31, the door hook 312 is engaged with the limiting portion 21. At this moment, when the user pulls the door body 31, the front surface of the door hook 312 is engaged with the limiting portion 21, and the door hook 312 cannot be disengaged from the limiting portion 21.

When the user presses the flipping member 100 backwards, an end of the flipping member 100 in contact with the rotating member 22 rotates upward (in the up-down direction as shown in FIG. 11, it should be understood here that the above-mentioned direction is used to describe the drawings, but does not limit the actual setting position and direction of the latching structure 10 for the cooking device 1), to drive the rotating member 22 to rotate upward. When the rotating member 22 rotates to a certain position, the rotating member 22 is brought into contact with the door hook 312 to drive the door hook 312 to rotate upward. That is to say, the flipping member 100, when rotating, can drive the door hook 312 to rotate upward through the rotating member 22, so that the door hook 312 is disengaged from the limiting portion 21, and the user can pull the door body 31 to open the casing 32, or the user presses the flipping member 100 and the door body 31 automatically pops forward to open the casing 32.

When the user needs to close the casing 32, the door body 31 can be operated to move backward. At this moment, the rear surface of the door hook 312 is engaged with the limiting portion 21. When the user presses the door body 31 backward, since the rear surface of the door hook 312 is formed in an arc shape, the door hook 312 can rotate upward by the reaction force of the limiting portion 21 acting thereon. After the door hook 312 rotates upward by a certain distance and the rear surface of the door hook 312 is disengaged from the limiting portion 21, the door hook 312 is engaged with the limiting portion 21, and at this moment, the casing 32 can be closed by the door body 31.

In some embodiments of the present disclosure, the door body 31 is rotatably connected to the casing 32, and the door body 31 is rotatable relative to the casing 32 to open or close the casing 32. The door body 31 and the casing 32 can be rotatably connected through, but not limited to a hinged manner, as long as the door body 31 and the casing 32 can be rotatably connected together. In addition, in some embodiments, the door body 31 can be connected to the casing 32 in a non-detachable manner, so that the cooking device 1 has a good structural integrity, a firm installation, and a beautiful appearance. In some other embodiments, the door body 31 can be detachably connected to the casing 32, so that if a structure in the casing 32 is damaged, the door body 31 can be disassembled from the casing 32 for maintenance.

By using the latching structure 10 for the cooking device 1 according to the above-mentioned embodiments of the present disclosure, the cooking device 1 according to the embodiments of the present disclosure has the advantages of locking the door body 31, protecting children from being scalded due to accidental touch, having a relatively simple structure, and facilitating cost reduction.

In some embodiments of the present disclosure, the casing 32 has a control box 2 provided thereon. The control box 2 is configured to control an operation state of the cooking device 1. The latching structure 10 is located on a rear side of the control box 2. The user can operate the control box 2 to operate on the working state of the cooking device 1. The latching structure 10 is disposed on the rear side of the control box 2, so as to ensure the overall aesthetics of the cooking device 1. In some embodiments of the present disclosure, the casing 32 has a door-opening button 33 provided thereon. The door-opening button 33 is configured to trigger the flipping member 100. The casing 32 has a press button 111 provided on a side wall thereof adjacent to the door-opening button 33, which is convenient for the user to operate the door-opening button 33 and the press button 111.

In some embodiments, as illustrated in FIG. 11, the door-opening button 33 is disposed on a lower left end of the front surface of the casing 32, and the press button 111 is disposed on a lower right end of the left surface of the casing 32. On the one hand, it is convenient for the user to operate the door-opening button 33 and the press button 111 at the same time. On the other hand, the door-opening button 33 and the press button 111 are arranged in adjacent areas, so that the press button 111 can drive the restricting member 12 to be engaged with the abutting-stopping portion 110 on the flipping member 20 or the avoidance space 120.

Other structures and operations of the cooking device 1 according to the embodiments of the present disclosure are known to those of ordinary skill in the art, and will not be described in detail here.

It should be understood that in the description of the present disclosure, the orientations or positional relations indicated by the terms "center", "longitudinal", "lateral", "length", "width", "thickness", "upper", "lower", "front", "rear", "left", "right", "vertical", "horizontal", "top", "bottom", "inner", "outer", "clockwise", "counterclockwise", "axial", "radial", "circumferential", etc. are based on the orientations or positional relations shown in the accompanying drawings, which are only for the convenience of describing the present disclosure and simplifying the description, rather than indicating or implying that the indicated apparatuses or elements must have a specific orientation or be constructed and operate in a specific orientation, and therefore should not be construed as limiting the present disclosure. Furthermore, features delimited with "first" and "second" may expressly or implicitly include one or more of the features. In the description of the present disclosure, unless stated otherwise, "plurality" means two or more. In the description of the present disclosure, a first feature being "above" or "under" a second feature may include that the first and second features are in direct contact, or that the first and second features are not in direct contact but in contact through an additional feature between them.

In the description of the present disclosure, the first feature being "above", "over" and "on" the second feature includes a case where the first feature is directly above the second feature and a case where the first feature is obliquely above the second feature, or simply means that the first feature has a level higher than a level of the second feature.

In the description of the present disclosure, it should be noted that, unless otherwise expressly specified and limited, the terms "installed", "connect" and "connected" should be understood in a broad sense. For example, it can be a fixed connection or a detachable connection, or an integral connection; it can be a mechanical connection, or an electrical connection; and it can be a directly connection, or an indirect connection through an intermediate medium, or an internal communication between two elements. For those of ordinary skill in the art, the specific meanings of the above terms in the present disclosure can be understood in specific situations.

In the description of this specification, the description with reference to the term "an embodiment", "some embodiment", "exemplary embodiment" "example", "specific example", "some examples", etc. means that particular features, structures, materials, or characteristics described in combination with the embodiments or the examples are included in at least one embodiment or example of the present disclosure. In this specification, schematic representations of the above terms do not necessarily refer to the same embodiment or example. Furthermore, the particular features, structures, materials or characteristics described may be combined in any suitable manner in any one or more embodiments or examples.

Although the embodiments of the present disclosure have been shown and described, it will be understood by those of ordinary skill in the art that various changes, modifications, substitutions and variations can be made to these embodiments without departing from the principles and ideas of the present disclosure, and the scope of the present disclosure is defined by the claims and their equivalents

What is claimed is:

1. A latching structure for a cooking device, wherein the cooking device comprises a casing and a door body, the door body being engaged with the casing in an openable and closable manner, the latching structure comprising:

a flipping member rotatably disposed on the casing, the flipping member being configured to drive, in response to being triggered to rotate to a door-opening position, a hook of the door body to be disengaged from a limiting portion of the casing;

a first restoring member connected to the flipping member and the casing respectively, the first restoring member being configured to provide the flipping member with a first restoring force for allowing the flipping member to rotate towards a non-triggered position;

a restricting member movably disposed on the casing between a first position in which the restricting member blocks the flipping member from rotating towards the door-opening position and a second position in which the restricting member avoids a rotation of the flipping member; and a second restoring member connected to the restricting member and the casing respectively, the second restoring member being configured to provide the restricting member with a second restoring force for allowing the restricting member to move towards the first position, wherein the latching structure is configured such that under the first restoring force, a restoring speed at which the flipping member rotates towards the non-triggered position is greater than a restoring speed at which the restricting member moves from the second position towards the first position, to allow the restricting member to avoid restoration of the flipping member.

2. The latching structure for the cooking device according to claim 1, the latching structure further comprising a damping member connected to the restricting member and the casing respectively, the damping member providing a damping force to reduce the restoring speed at which the restricting member moves towards the first position.

3. The latching structure for the cooking device according to claim 1, wherein the first restoring force is greater than the second restoring force such that the restoring speed of the flipping member is greater than the restoring speed of the restricting member.

4. The latching structure for the cooking device according to claim 1, wherein the restricting member comprises a first abutting portion and the flipping member comprises a second abutting portion, wherein when the restricting member is in the first position, the second abutting portion at least partially abuts on the first abutting portion, and wherein when the restricting member is in the second position, the second abutting portion and the first abutting portion are completely staggered with each other.

5. The latching structure for the cooking device according to claim 4, wherein:

the restricting member further comprises a first avoiding portion corresponding to the second abutting portion, the first avoiding portion and the first abutting portion being staggered with each other, the flipping member further comprises a second avoiding portion corresponding to the first abutting portion, the second avoiding portion and the second abutting being staggered with each other, and when the restricting member is in the second position, the first abutting portion enters the second avoiding portion, and the second abutting portion enters the first avoiding portion.

6. The latching structure for the cooking device according to claim 2, the latching structure further comprising a support base disposed on the casing and connected to the second restoring member and the damping member respectively, wherein the restricting member is movably engaged with the support base.

7. The latching structure for the cooking device according to claim 6, wherein the support base has one of a guide groove and a guide portion defined thereon, and the restricting member has the other of the guide groove and the guide portion defined thereon, the guide portion extending into the guide groove, and the restricting member being movable relative to the support base in an extending direction of the guide groove to switch between the first position and the second position.

8. The latching structure for the cooking device according to claim 6, wherein the support base comprises a cover body and a bracket, and an accommodating chamber for accommodating the damping member is formed between the cover body and the bracket.

9. The latching structure for the cooking device according to claim 1, the latching structure further comprising:

a fixing base disposed on the casing and having a first guide groove running therethrough; and a press button extending into the first guide groove and movable relative to the fixing base in a direction, in which the first guide groove runs through the fixing base, to push the restricting member to move.

10. The latching structure for the cooking device according to claim 9, wherein the press button comprises:

a first action member matching the first guide groove and having a pressing surface; and a force applying member connected to a surface of the first action member facing away from the pressing surface, the force applying member interacting with the restricting member to push the restricting member to move.

11. The latching structure for the cooking device according to claim 10, wherein the first guide groove has a second guide groove defined on each of opposite side walls thereof, and the press button further comprises a guide member protruding relative to the first action member, the guide member extending into the second guide groove and being movable relative to the fixing base in an extending direction of the second guide groove.

12. The latching structure for the cooking device according to claim 9, the latching structure further comprising a disabling member detachably engaged with the fixing base, wherein the disabling member is configured to press, in response to being engaged with the fixing base, the press button to cause the restricting member to be maintained in the second position against the second restoring force.

13. The latching structure for the cooking device according to claim 12, wherein the disabling member has an elastic protrusion provided thereon, the elastic protrusion being engaged with the second guide groove in such a manner that the disabling member is detachable relative to the fixing base.

14. A cooking device comprising:

a casing having a limiting portion provided thereon;

a door body engaged with the casing in an openable and closable manner, the door body having a hook provided thereon; and the latching structure according to claim 1, wherein the latching structure is disposed on the casing, wherein the flipping member is engaged with the hook, and wherein the flipping member is configured to drive, in response to being triggered to rotate to the door-opening position, the hook to be disengaged from the limiting portion.

15. The cooking device according to claim 14, wherein the casing has a control box provided thereon, the control box being configured to control an operation state of the cooking device, and the latching structure being located on a rear side of the control box.

16. The cooking device according to claim 14, wherein the casing has a door-opening button provided thereon, the door-opening button being configured to trigger the flipping member, and wherein the casing further has a press button provided on a side wall thereof adjacent to the door-opening button, the press button being configured to push the restricting member to move.

* * * * *